US012281647B2

(12) United States Patent
Bartels et al.

(10) Patent No.: US 12,281,647 B2
(45) Date of Patent: Apr. 22, 2025

(54) LOCKING ASSEMBLY APPARATUS FOR PUMP SYSTEMS, AND RELATED METHODS

(71) Applicant: FORUM US, INC., Houston, TX (US)

(72) Inventors: Heinrich Bartels, Houston, TX (US); Stephen Patterson, Westhill (GB); Sohaib Anwer, Houston, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 18/416,032

(22) Filed: Jan. 18, 2024

(65) Prior Publication Data

US 2024/0151224 A1 May 9, 2024

Related U.S. Application Data

(63) Continuation of application No. 18/083,189, filed on Dec. 16, 2022.

(60) Provisional application No. 63/291,568, filed on Dec. 20, 2021.

(51) Int. Cl.
*F04B 53/14* (2006.01)
*F04B 53/22* (2006.01)

(52) U.S. Cl.
CPC ..... *F04B 53/14* (2013.01); *F04B 53/147* (2013.01); *F04B 53/22* (2013.01)

(58) Field of Classification Search
CPC ..... F04B 53/14; F04B 53/22; F04B 53/147
See application file for complete search history.

(56) References Cited

U.S. PATENT DOCUMENTS 10,036,384 B1 * 7/2018 Jahnke ..... F16J 7/00
2004/0261554 A1 * 12/2004 Tylosky ..... F16B 7/06 74/89.39
2014/0144706 A1 * 5/2014 Bailey ..... E21B 21/10 175/218
2021/0088035 A1 * 3/2021 Maras ..... F04B 53/146

OTHER PUBLICATIONS

International Search Report and the Written Opinion for PCT US2022/053310 dated Mar. 9, 2023.

* cited by examiner

*Primary Examiner* — Dominick L Plakkoottam
(74) *Attorney, Agent, or Firm* — Patterson + Sheridan, LLP

(57) ABSTRACT

Aspects of the present disclosure relate to locking assembly apparatus for piston apparatus and pony rod apparatus of pump systems (such as mud or frac pump systems), and related methods. In one aspect, the locking assembly is a mechanical locking assembly used to quickly and simply lock and unlock (e.g., release) a piston apparatus to and from a pony rod apparatus.

24 Claims, 18 Drawing Sheets

LOCKING ASSEMBLY APPARATUS FOR PUMP SYSTEMS, AND RELATED METHODS

CROSS REFERENCE TO RELATED APPLICATIONS

This application is a continuation of U.S. patent application Ser. No. 18/083,189, filed Dec. 16, 2022, which claims benefit of U.S. Provisional Patent Application No. 63/291,568, filed Dec. 20, 2021, each of which is herein incorporated by reference in its entirety.

BACKGROUND

Field

Aspects of the present disclosure relate to locking assembly apparatus for piston apparatus and pony rod apparatus of pump systems (such as mud or frac pump systems), and related methods. In one aspect, the locking assembly is a mechanical locking assembly used to quickly and simply lock and unlock (e.g., release) a piston apparatus to and from a pony rod apparatus.

Description of the Related Art

Servicing, repair, and/or replacement of components of a pump system (such as a mud or frac pump system) can involve substantial costs, operational delays, and complexities. As an example, it can take several hours to remove a piston from a fluid end of the pump system, and service, repair, and/or replace a component (such as a liner) of the fluid end. Equipment of the pump system can also be susceptible to operational movements. For example, movement of a component of a piece of equipment during operation can result in unthreading/unlocking between two components, which may lead to a failure.

Therefore, there is a constant need for new and/or improved locking assembly apparatus for use with pump systems.

SUMMARY

Aspects of the present disclosure relate to locking assembly apparatus for piston apparatus and pony rod apparatus of pump systems (such as mud or frac pump systems), and related methods. In one aspect, the locking assembly is a mechanical locking assembly used to quickly and simply lock and unlock (e.g., release) a piston apparatus to and from a pony rod apparatus.

In one implementation, a locking assembly for piston apparatus includes an outer housing, an actuator wedge having one or more outer surfaces, an actuator rod disposed through the actuator wedge, and an actuator nut disposed at a first end of the actuator rod. The locking assembly also includes a first ram disposed in the outer housing and disposed on a first side of the actuator wedge. The first ram includes a first ram head, and the first ram head includes a first inward surface and a first shoulder surface opposing the first inward surface. The first inward surface faces the one or more outer surfaces of the actuator wedge. The first ram includes a first ram rod. The locking assembly includes a second ram disposed in the outer housing and disposed on a second side of the actuator wedge. The second ram includes a second ram head, and the second ram head includes a second inward surface and a second shoulder surface opposing the second inward surface. The second inward surface faces the one or more outer surfaces of the actuator wedge. The second ram includes a second ram rod. The locking assembly includes a first spring disposed about the first ram rod and abutting against the first ram head, and a second spring disposed about the second ram rod and abutting against the second ram head.

In one implementation, a pump system for drilling or fracing operations includes a power end, a fluid end, and a pony rod apparatus disposed at least partially outside of the fluid end. The pony rod apparatus includes a first pin opening. The pump system includes a piston apparatus disposed at least partially in the fluid end. The piston apparatus includes a second pin opening. The pump system includes a locking assembly coupled between the piston apparatus and the pony rod apparatus. The locking assembly includes an outer housing, an actuator wedge having one or more outer surfaces, an actuator rod disposed through the actuator wedge, an actuator nut disposed at a first end of the actuator rod, and a first ram disposed in the outer housing and disposed on a first side of the actuator wedge. The first ram includes a first ram head. The first ram head includes a first inward surface and a first shoulder surface opposing the first inward surface. The first inward surface faces the one or more outer surfaces of the actuator wedge. The first ram includes a first ram rod. The locking assembly includes a second ram disposed in the outer housing and disposed on a second side of the actuator wedge. The second ram includes a second ram head. The second ram head includes a second inward surface and a second shoulder surface opposing the second inward surface. The second inward surface faces the one or more outer surfaces of the actuator wedge. The second ram includes a second ram rod. The locking assembly includes a first spring disposed about the first ram rod and abutting against the first ram head, and a second spring disposed about the second ram rod and abutting against the second ram head. The locking assembly includes a female end connection coupled to the first ram rod, the female end connection having a first pin opening. The locking assembly includes a male end connection coupled to the second ram rod, the male end connection having a second pin opening. The locking assembly includes a first retention pin disposed through the first pin opening of the female end connection and the first pin opening of the pony rod apparatus, and a second retention pin disposed through the second pin opening of the male end connection and the second pin opening of the piston apparatus.

In one implementation, a method of using a pump system includes positioning a male end of a pony rod apparatus into a female end connection of a locking assembly, the female end connection having a first pin opening. The method includes positioning a male end connection of the locking assembly into a female end of the piston apparatus, the male end connection having a second pin opening. The method includes turning an actuator nut of the locking assembly to move an actuator wedge of the locking assembly to a first position. The actuator rod is disposed through the actuator wedge and the actuator nut is disposed at a first end of the actuator rod. The movement of the actuator wedge to the first position includes actuating a first shoulder surface of a first ram and a second shoulder surface of a second ram outward to compress a first spring and a second spring, aligning an opening of an outer housing of the locking assembly with the first pin opening of the female end connection and a first pin opening of the pony rod apparatus, and aligning a second pin opening of the piston apparatus with the second pin opening of the male end connection. The method includes disposing a first retention pin through the opening of the outer housing of the locking assembly, through the first pin opening of the female end connection, and through the first pin opening of the pony rod apparatus. The method includes disposing a second retention pin through the second pin opening of the piston apparatus and through the second pin opening of the male end connection. The method includes turning the actuator nut of the locking assembly to move the actuator wedge of the locking assembly to a second position. The movement of the actuator wedge to the second position includes biasing the first spring and the second spring inwardly against the first shoulder surface of the first ram and the second shoulder surface of the second ram to bias the first retention pin with the female end connection and bias the second retention pin with the male end connection, and applying locking forces inwardly against the first retention pin and the second retention pin. The first ram is disposed in an outer housing and disposed on a first side of the actuator wedge. The first ram includes a first ram head having a first inward surface and the first shoulder surface opposing the first inward surface, and a first ram rod. The first spring is disposed about the first ram rod. The second ram is disposed in the outer housing and disposed on a second side of the actuator wedge. The second ram includes a second ram head having a second inward surface and the second shoulder surface opposing the second tapered surface, and a second ram rod. The second spring is disposed about the second ram rod.

In one implementation, a pump system comprises a power end; a fluid end; a pony rod apparatus disposed at least partially outside of the fluid end; a piston apparatus disposed at least partially in the fluid end; and a locking assembly coupled between the pony rod apparatus and the piston apparatus, the locking assembly comprising: an outer housing, an actuator disposed in the outer housing, a first drive member threadedly coupled to the actuator, a second drive member threadedly coupled to the actuator, a first ram disposed in the outer housing, a first spring configured to bias the first ram toward the actuator, a second ram disposed in the outer housing, and a second spring configured to bias the second ram toward the actuator; wherein rotation of the actuator moves the first drive member to move the first ram in a direction away from the actuator, thereby compressing the first spring, to couple the first ram to the piston apparatus; and wherein rotation of the actuator moves the second drive member to move the second ram in a direction away from the actuator, thereby compressing the second spring, to couple the second ram to the pony rod apparatus.

In one implementation, a pump system comprises a power end; a fluid end; a pony rod apparatus disposed at least partially outside of the fluid end; a piston apparatus disposed at least partially in the fluid end; and a locking assembly coupled between the pony rod apparatus and the piston apparatus, the locking assembly comprising: a first outer housing, a female end connection at least partially disposed in the first outer housing and coupled to the pony rod apparatus, a second outer housing, a male end connection at least partially disposed in the second outer housing and coupled to the pony rod apparatus, a first actuator wedge disposed between the first and second outer housings, wherein the first actuator wedge comprises tapered surfaces that engage corresponding tapered surfaces on the first and second outer housings, a second actuator wedge disposed between the first and second outer housings, wherein the second actuator wedge comprises tapered surfaces that engage corresponding tapered surfaces on the first and second outer housings, an actuator rod that extends through the first and second actuator wedges, a first spring configured to bias the first outer housing toward the second outer housing, and a second spring configured to bias the second outer housing toward the first outer housing; wherein rotation of the actuator rod in a first direction causes the first and second actuator wedges to move outward and away from each other such that the first and second springs move the first and second outer housings inward and toward each other via the tapered surfaces of the actuator wedges and the outer housings; and wherein rotation of the actuator rod in a second, opposite direction causes the first and second actuator wedges to move inward and toward each other, which move the first and second outer housings outward and away from each other via the tapered surfaces of the actuator wedges and the outer housings, thereby compressing the first and second springs.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
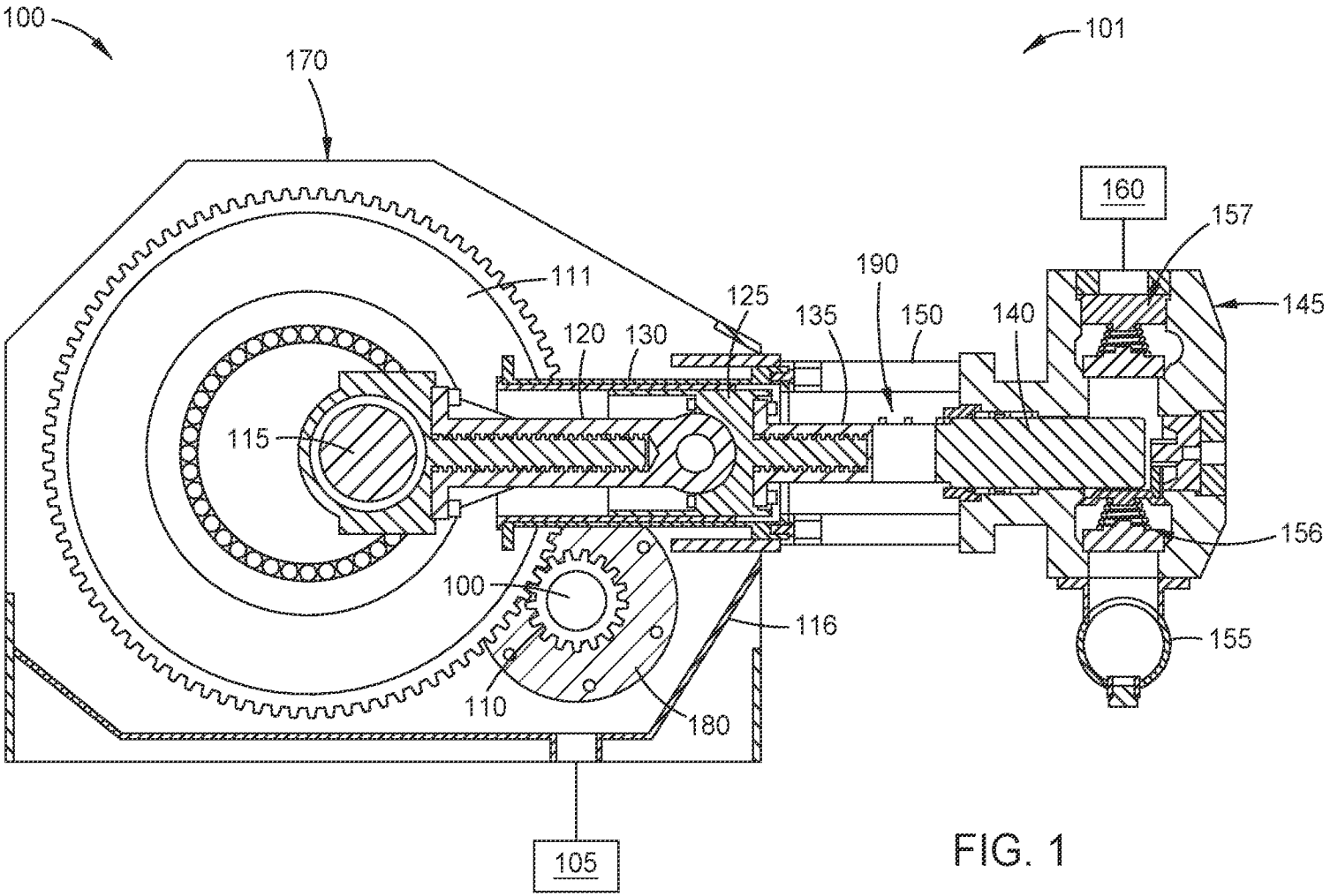
FIG. 1 is a schematic partial sectional view of a pump system, according to one implementation.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Aspects of the present disclosure relate to locking assembly apparatus for piston apparatus and pony rod apparatus of pump systems (such as mud or frac pump systems), and related methods. In one aspect, the locking assembly is a mechanical locking assembly used to quickly and simply lock and unlock (e.g., release) a piston apparatus to and from a pony rod apparatus.

The disclosure contemplates that terms such as "couples," "coupling," "couple," and "coupled" may include but are not limited to welding, interference fitting, and/or fastening such as by using bolts, threaded connections, and/or screws. The disclosure contemplates that terms such as "couples," "coupling," "couple," and "coupled" may include but are not limited to integrally forming as part of a monolithic body. The disclosure contemplates that terms such as "couples," "coupling," "couple," and "coupled" may include but are not limited to direct coupling and/or indirect coupling.

FIG. 1 is a schematic partial sectional view of a pump system 100, according to one implementation. The pump system 100 includes a reciprocating pump 101. The reciprocating pump 101 is of a type utilized for oil and gas well service operations, such as pumping high pressure fluid into a well for drilling operations or to hydraulically fracture a hydrocarbon bearing reservoir. In one example, which can be combined with other examples, the reciprocating pump 101 may be configured for pumping drilling fluid into a well during drilling of the well. In one example, which can be combined with other examples, the reciprocating pump 101 is a mud pump. In one example, which can be combined with other examples, the reciprocating pump 101 is a frac pump. The reciprocating pump 101 of the pump system 100 includes a power end 170 and a fluid end 145.

The reciprocating pump 101 may include a power source 105, such as a motor, operably coupled to a pinion shaft 100 to rotate the pinion shaft 100. The pinion shaft 100 includes pinion gears 110 on both ends of the pinion shaft 100 (one pinion gear 110 is shown). Gear teeth on the pinion gears 110 mate with gear teeth on corresponding bull gears 111 (one bull gear 111 is shown in FIG. 1) to drive the bull gears 111, which are connected to a crankshaft 115. In one example, which can be combined with other examples, the gear teeth of the pinion gears 110 and the gear teeth of the bull gears 111 are timed to facilitate operation and performance of the reciprocating pump 101. The pinion shaft 100 is supported in a housing 116 of the power end 170 by bearings.

A hub 180 is coupled to the pinion shaft 100 adjacent or at each end of the pinion shaft 100 (one hub 180 is shown in FIG. 1). In one example, the hub 180 is shrink fitted to the pinion shaft 100 of the power end 170. The hub 180 may be removed from the pinion shaft 100 and moved away from the pinion shaft 100 to facilitate maintaining, servicing, repairing, and/or replacing components of the reciprocating pump 101.

One or more connecting rods 120 are coupled to the crankshaft 115. Each connecting rod 120 is connected to a crosshead 125, and each crosshead 125 moves in a linear stroke within a stationary crosshead casing 130. A pony rod apparatus 135 disposed outside of the fluid end 145 secures each crosshead 125 to a piston apparatus 140 (also referred to as a plunger apparatus) disposed at least partially in the fluid end 145. The piston apparatus 140 is stroked (e.g. moved back and forth) by the power end 170 via a connection to the pony rod apparatus 135 as further described below. Tie rods 150 couple the fluid end 145 to an end portion of the power end 170. As the piston apparatus 140 is stroked, fluid is brought into the fluid end 145 from an intake 155 and through a first valve 156, and discharged at higher pressure through a second valve 157 and out a discharge 160. In one example, which can be combined with other examples, the piston apparatus 140 has a length of about 6 inches or more, such as 5.5 inches or more. In one example, which can be combined with other examples, the pony rod apparatus 135 has a length within a range of 12 inches to 20 inches.

A locking assembly 190 is coupled between each pony rod apparatus 135 and each respective piston apparatus 140. The locking assembly 190 can be locked to secure the piston apparatus 140 to the pony rod apparatus 135 after the piston apparatus 140 is disposed at least partially in the fluid end 145 (such as in a fluid cylinder of the fluid end 145). The locking assembly 190 is shown without hatching in FIG. 1 for purposes of clarity.

Figure 2A:
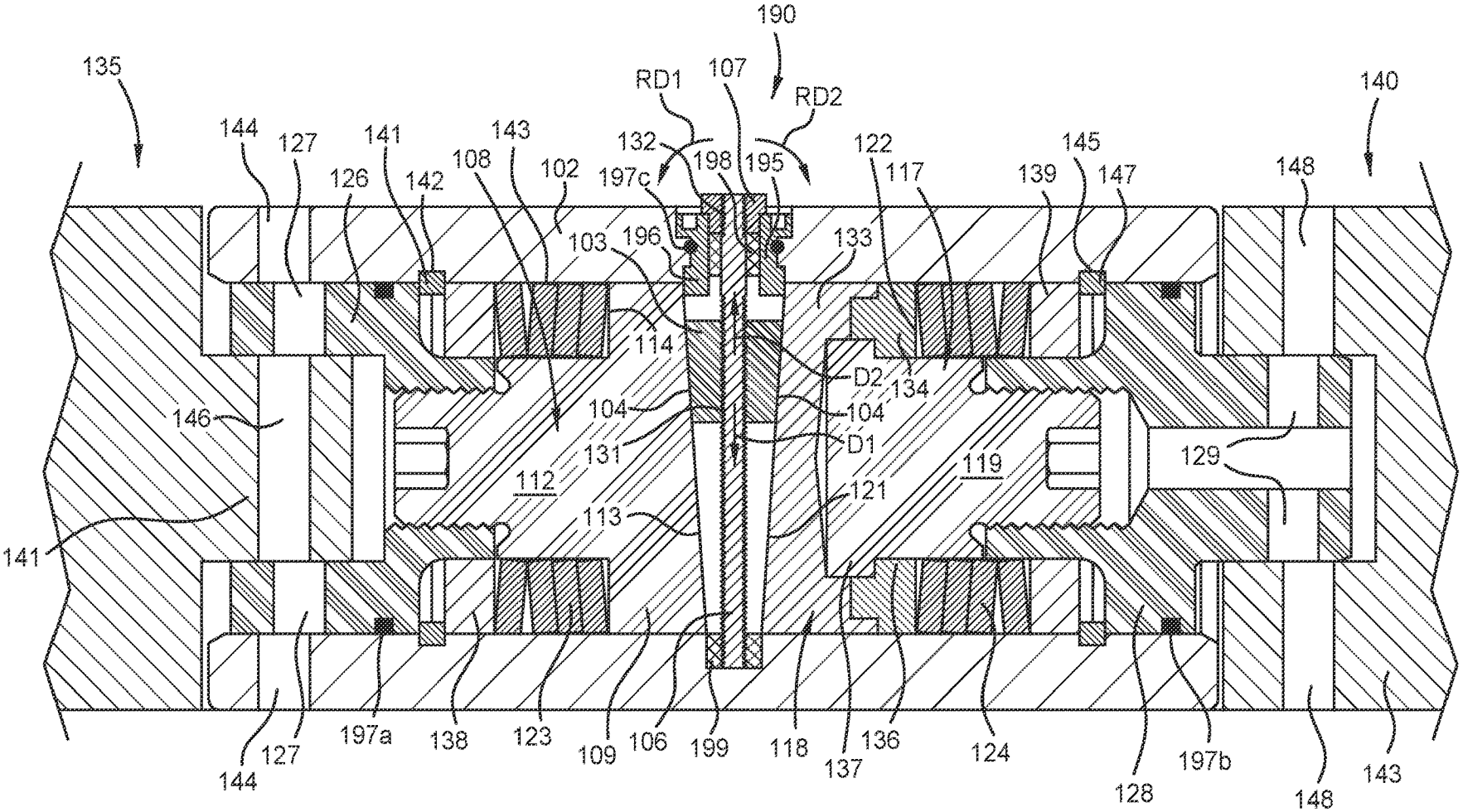
FIG. 2A is a schematic side cross-sectional view of a locking assembly, according to one implementation.

FIG. 2A is a schematic side cross-sectional view of the locking assembly 190 shown in FIG. 1, according to one implementation. The locking assembly 190 includes an outer housing 102, an actuator wedge 103 having one or more outer surfaces 104, and an actuator rod 106 disposed through the actuator wedge 103. The locking assembly 190 includes an actuator nut 107 disposed at a first end of the actuator rod 106, and a first ram 108 disposed in the outer housing 102 and disposed on a first side of the actuator wedge 103. The actuator nut 107 is hexagonal in shape, and can be turned with a wrench or an impact driver, for example. The first ram 108 includes a first ram head 109 and a first ram rod 112. The first ram head 109 includes a first inward surface 113 and a first shoulder surface 114 opposing the first inward surface 113. The first inward surface 113 faces the one or more outer surfaces 104 of the actuator wedge 103.

The locking assembly 190 includes a second ram 117 disposed in the outer housing 102 and disposed on a second side of the actuator wedge 103. The second ram 117 includes a second ram head 118 and a second ram rod 119. The second ram head 118 includes a second inward surface 121 and a second shoulder surface 122 opposing the second inward surface 121. The second inward surface 121 faces the one or more outer surfaces 104 of the actuator wedge 103.

The locking assembly 190 includes a first spring 123 disposed about the first ram rod 112 and abutting against the first ram head 109, and a second spring 124 disposed about the second ram rod 119 and abutting against the second ram head 118. Each of the first spring 123 and the second spring 124 is a mechanical spring. In one embodiment, which can be combined with other embodiments, each of the first spring 123 and the second spring 124 is a disc spring. In one embodiment, which can be combined with other embodiments, each of the first spring 123 and the second spring 124 is a metallic or non-metallic compression spring.

The actuator rod 106 is coupled to the actuator wedge 103 using a first threaded interface 131. In the implementation shown in FIG. 2A, the actuator nut 107 is coupled to the first end of the actuator rod 106 using a second threaded interface 132. The present disclosure contemplates that the actuator nut 107 can be integrally formed with the actuator rod 106.

The locking assembly 190 includes a blocker ring 195. The blocker ring 195 includes an outer shoulder disposed at least partially in an inner recess 196 of the outer housing 102. In one embodiment, which can be combined with other embodiments, the first ram 108 and the second ram 117 abut against the blocker ring 195 when the locking assembly 190 is in the unlocked position. The locking assembly includes a plurality of seals 197*a*-197*c*, such as O-ring seals. The locking assembly 190 includes a first retainer 198 and a second retainer 199 disposed about the actuator rod 106 to facilitate retaining the actuator rod 106 in the position shown in FIG. 2A while allowing the actuator rod 106 to rotate about a central axis thereof during operation.

Each of the first inward surface 113 and the second inward surface 121 is tapered. The one or more outer surfaces of the actuator wedge are tapered to interface with the first inward surface and the second inward surface. In the implementation shown in FIG. 2A, the first ram head 109 and the first ram rod 112 are integrated into a monolithic body. In the implementation shown in FIG. 2A, the second ram head 118 includes a cap ring 133 having the second inward surface 121 abutting against a locking ring 134 having the second shoulder surface 122. An inner head shoulder 136 of the locking ring 134 abuts against an outer rod shoulder 137 of the second ram rod 119. The first spring 123 is disposed between the first shoulder surface 114 of the first ram head 109 and a first spacer ring 138 disposed in the outer housing 102. The second spring 124 is disposed between the second shoulder surface 122 of the locking ring 134 and a second spacer ring 139 disposed in the outer housing 102. The locking assembly 190 includes a first retainer ring 141 disposed in a first inner recess 142 formed in an inner surface 143 of the outer housing 102. The first retainer ring 141 is disposed between the female end connection 126 and the first spacer ring 138. A second retainer ring 147 disposed in a second inner recess 145 formed in the inner surface 143 of the outer housing 102. The second retainer ring 147 is disposed between the male end connection 128 and the second spacer ring 139.

The locking assembly 190 includes a female end connection 126 coupled to the first ram rod 112. The female end connection 126 includes first pin openings 127 configured to receive a first retention pin therein. The locking assembly 190 includes a male end connection 128 coupled to the second ram rod 119. The male end connection 128 includes second pin openings 129 configured to receive a second retention pin therein. The female end connection 126 is configured to couple to a male end 141 of the pony rod apparatus 135. The male end 141 of the pony rod apparatus 135 includes one or more first pin openings 146. The male end connection 128 is configured to couple to a female end 143 of the piston apparatus 140. The female end 143 of the piston apparatus 140 includes one or more second pin openings 148.

The locking assembly 190 is shown in an unlocked position in FIG. 2A. According to a method of using the locking assembly 190, the actuator nut 107 is turned in a first rotational direction RD1 to move the actuator wedge 103 in a first direction D1 along the actuator rod 106. The movement of the actuator wedge 103 slides the one or more outer surfaces 104 along the first and second inward surfaces 113, 121 to actuate the first and second rams 108, 117 outward. The movement of the actuator wedge 103 actuates the first shoulder surface 114 of the first ram 108 and the second shoulder surface 122 of the second ram 117 outward to compress the first spring 123 and the second spring 124.

The movement of the actuator wedge 103 aligns the first pin openings 127 with the first pin openings 146 and one or more pin openings 144 formed in the outer housing 102 such that a first retention pin can be disposed through first pin openings 127, the first pin openings 146 and the one or more pin openings 144. The movement of the actuator wedge 103 aligns the second pin openings 129 with the second pin openings 148 that a second retention pin can be disposed through second pin openings 129 and the second pin openings 148. The male end connection 128 and the second ram rod 119 are rotatable relative to the outer housing 102 to facilitate aligning the second pin openings 129 with the one or more second pin openings 148. The movement of the actuator wedge 103 in the first direction D1 moves the locking assembly 190 to a first position shown in FIG. 2B.

Figure 2B:
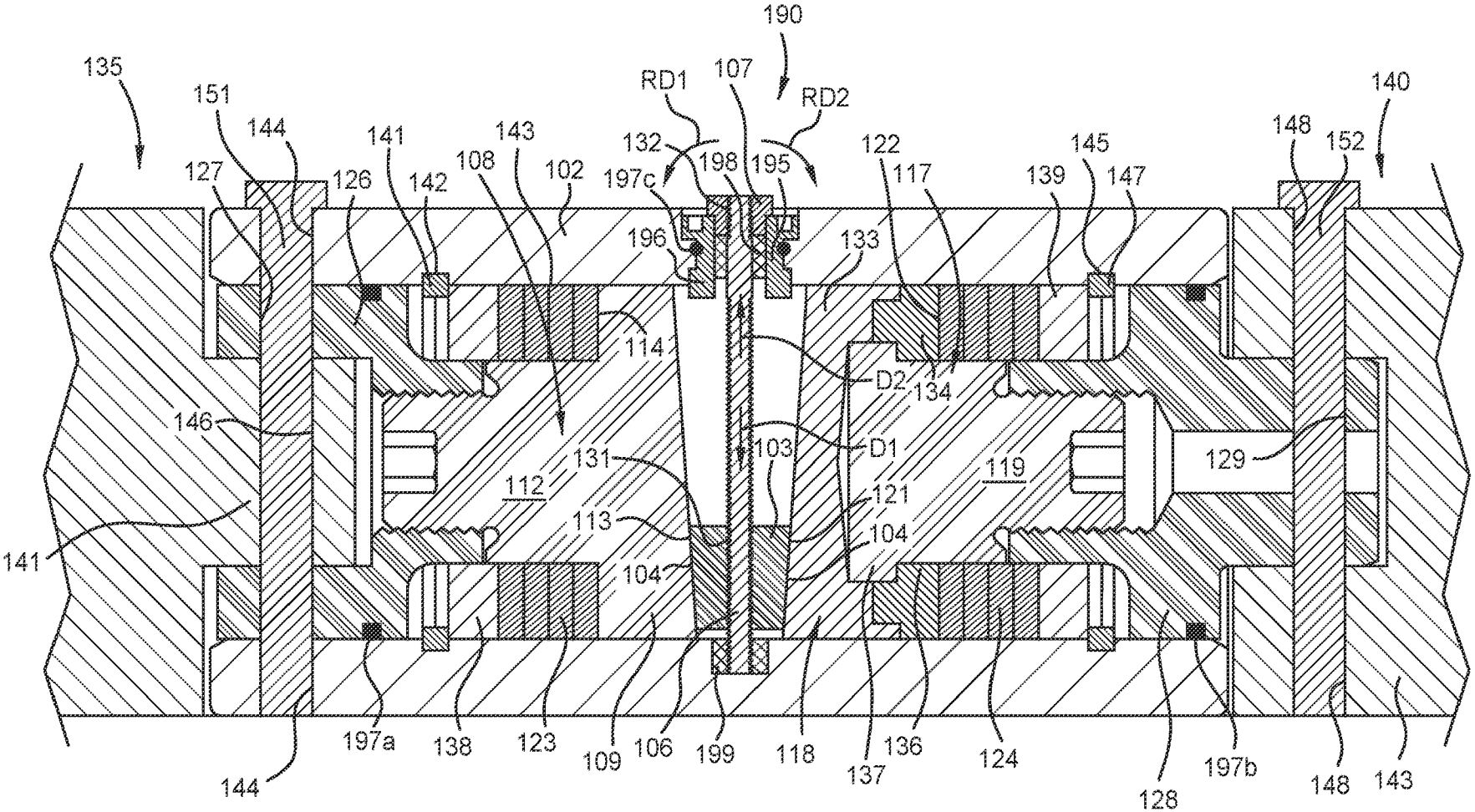
FIG. 2B is a schematic side cross-sectional view of the locking assembly shown in FIG. 2A in the first position, according to one implementation.

FIG. 2B is a schematic side cross-sectional view of the locking assembly 190 shown in FIG. 2A in the first position, according to one implementation. After the aligning, a first retention pin 151 is disposed through pin openings 127, 144, 146 and a second retention pin 152 is disposed through pin openings 129, 148. After disposition of the first and second retention pins 151, 152, the actuator nut 107 is turned in a second rotational direction RD2 that is opposite of the first rotational direction RD1. Turning of the actuator nut 107 in the second rotational direction RD2 moves the actuator wedge 103 in a second direction D2 that is opposite of the first direction D1. The movement of the actuator wedge 103 in the second direction D2 moves the locking assembly 190 to a second position shown in FIG. 2C.

Figure 2C:
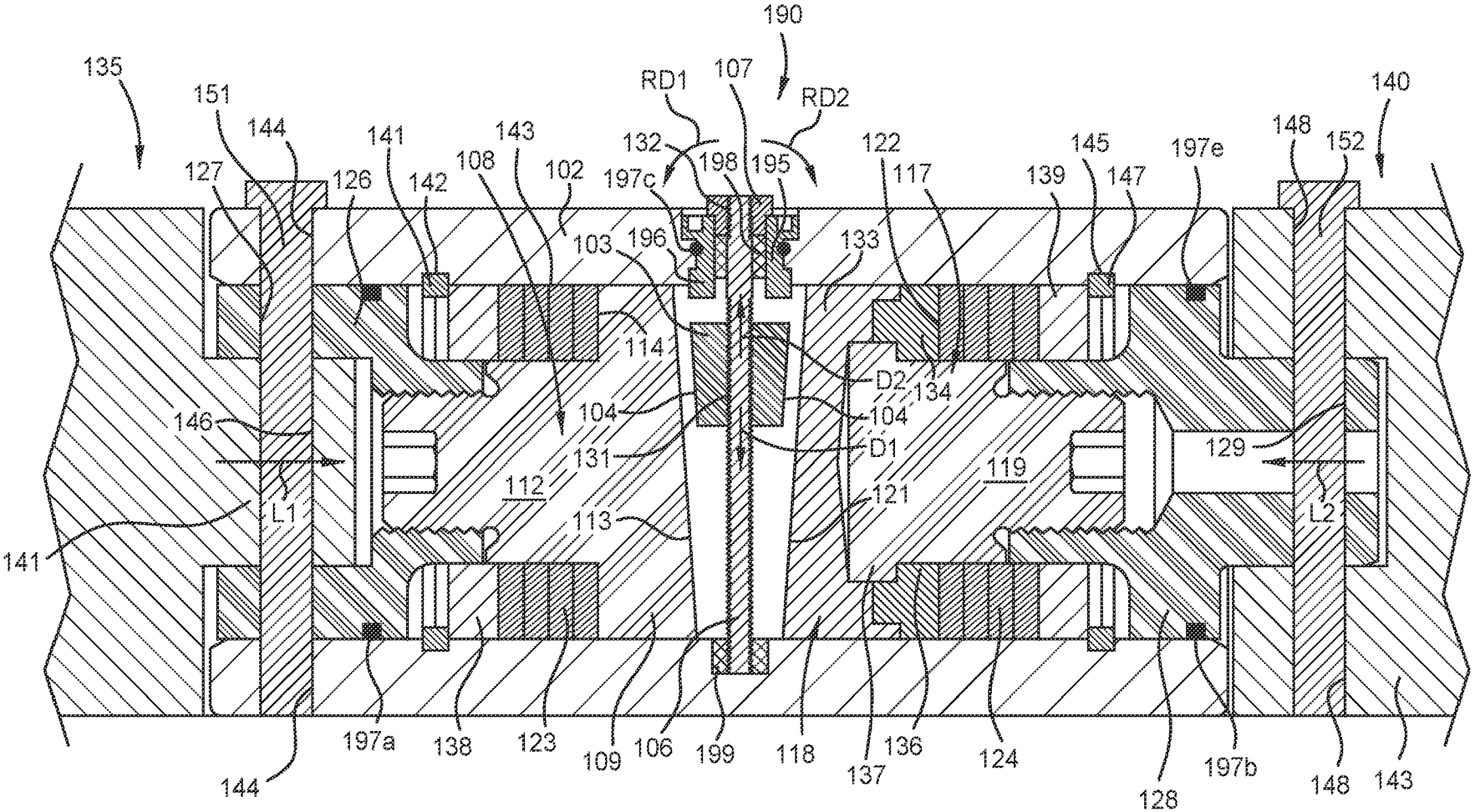
FIG. 2C is a schematic side cross-sectional view of the locking assembly shown in FIG. 2A in the second position, according to one implementation.

FIG. 2C is a schematic side cross-sectional view of the locking assembly 190 shown in FIG. 2A in the second position, according to one implementation. The movement of the actuator wedge 103 in the second direction D2 disengages the actuator wedge 103 from the rams 108, 117 to facilitate biasing the first spring 123 and the second spring 124 inwardly against the first shoulder surface 114 and the second shoulder surface 122. The biasing of the first spring 123 and the second spring 124 inwardly against the first shoulder surface 114 and the second shoulder surface 122 biases the first retention pin 151 with the female end connection 126 and biases the second retention pin 152 with the male end connection 128 to apply locking forces L1, L2 inwardly against the first retention pin 151 and the second retention pin 152. The second position is a locked position for the locking assembly 190.

The locking forces L1, L2 facilitate the retention pins 151, 152 staying retained in the respective openings 127, 144, 146 and openings 129, 148 to lock the piston apparatus 140 to the pony rod apparatus 135. During operation of the pump system 100 and stroking of the pony rod apparatus 135 and the piston apparatus 140, any movement of the actuator wedge 103 will not substantially reduce the locking forces L1, L2 applied to the first and second retention pins 151, 152, thereby facilitating the reliability of the locking assembly 190. When servicing, repair, and/or replacement of one or more components of the fluid end 145 is to be conducted, the actuator nut 107 is turned in the first rotational direction RD1 to re-engage the first and second rams 108, 117 with the actuator wedge 103 and reduce the locking forces L1, L2. Reduction of the locking forces L1, L2 facilitates removal of the second retention pin 152 from the openings 129, 148. After removal of the second retention pin 152 from the openings 129, 148, the male end connection 128 can be removed from the female end 143 of the piston apparatus 140, and the piston apparatus 140 can be removed from the fluid end 145 for servicing, repair, and/or replacement of the piston apparatus 140 and/or another components of the fluid end 145 (such as a liner).

Using aspects of the disclosure described herein, the locking assembly 190 can be unlocked, and the piston apparatus 140 can be removed from fluid end 145 in less than 1 minute, such as 30 seconds or less.

Figure 3:
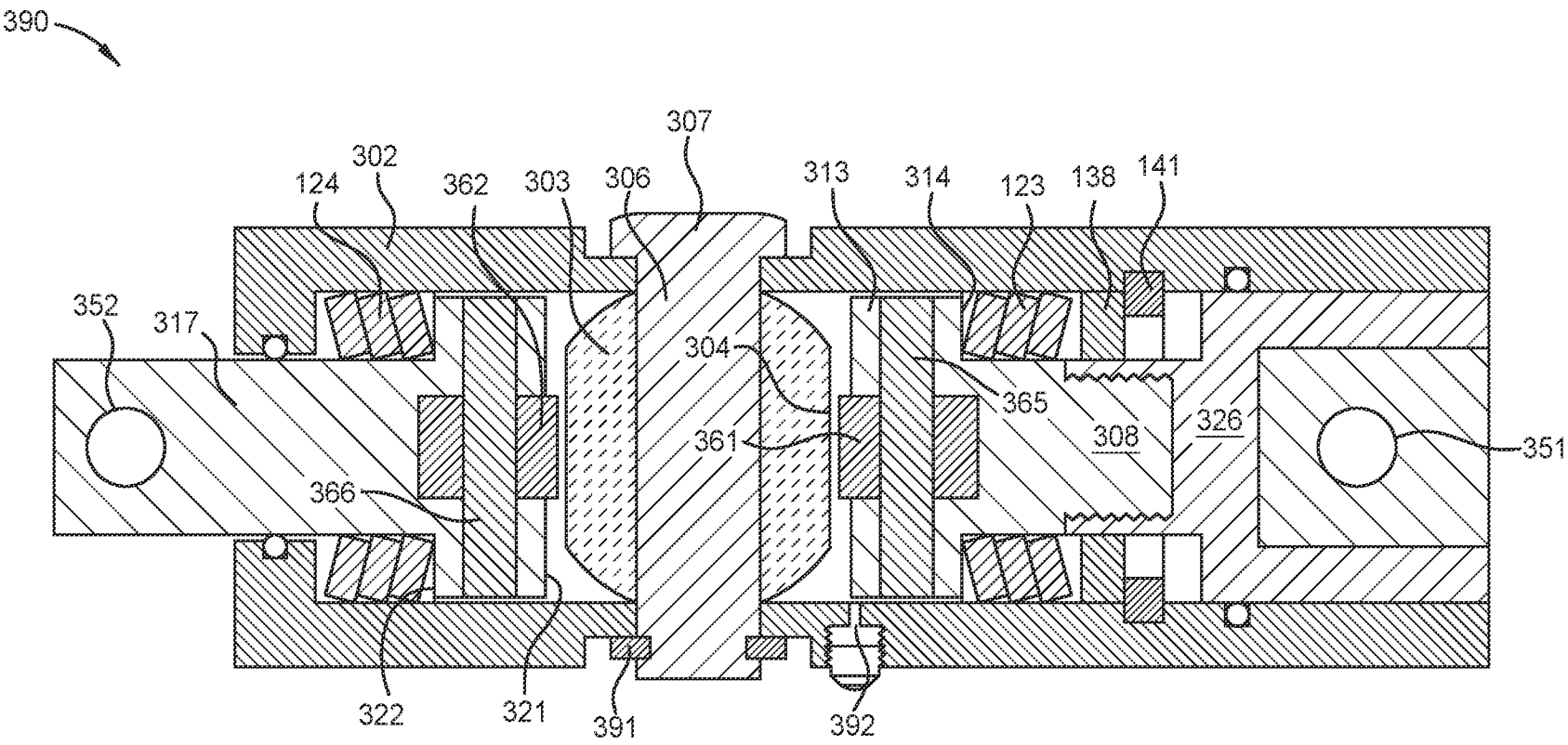
FIG. 3 is a schematic side cross-sectional view of a locking assembly, according to one implementation.

FIG. 3 is a schematic side cross-sectional view of a locking assembly 390, according to one implementation. Aspects, features, components, and/or properties of the locking assembly 390 can be used in place of and/or in addition to the aspects, features, components, and/or properties of the locking assembly 190 shown in FIG. 1 and FIG. 2A.

The locking assembly 390 includes an outer housing 302, an actuator wedge 303 having one or more outer surfaces 304, and an actuator rod 306. The locking assembly 390 includes an actuator nut 307 disposed at a first end of the actuator rod 306, and a first ram 308 disposed in the outer housing 302 and disposed on a first side of the actuator wedge 303. The first ram 308 includes a first inward surface 313 and a first shoulder surface 314 opposing the first inward surface 313. The actuator wedge 303, the actuator nut 307, and the actuator rod 306 are part of a cam actuator that converts rotational motion of the actuator nut 307 into translational motion of the first and second rams 308, 317.

The locking assembly 390 includes a second ram 317 disposed in the outer housing 302 and disposed on a second side of the actuator wedge 303. The second ram 317 includes a second inward surface 321 and a second shoulder surface 322 opposing the second inward surface 321. A female end connector 326 having one or more first pin openings 351 is coupled to the first ram 308. A male end connector having one or more second pin openings 352 is integrally formed with the second ram 317. One or more retainers 391, such as one or more circlips, are disposed adjacent a second end of the actuator rod 306. A lubricant port 392, such as a grease port, is formed in the outer housing 302.

The locking assembly 390 includes one or more first rollers 361 disposed partially in the first inward surface 313 of the first ram 308, and one or more second rollers 362 disposed partially in the second inward surface 321 of the second ram 317. The one or more first rollers 361 are disposed about a first rod 365 and the one or more second rollers 362 are disposed about a second rod 366. The one or more first rollers 361 and the one or more second rollers 362 are rotatable using one or more bearings disposed within and/or outside of the respective roller.

Figure 4A:
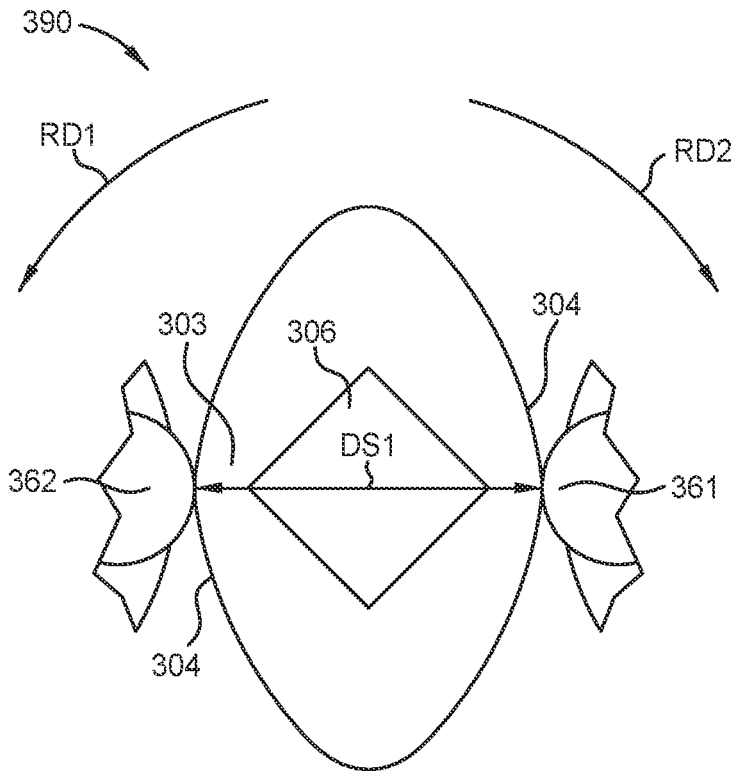
FIG. 4A is a schematic top view of an actuator rod and an actuator wedge shown in FIG. 3, according to one implementation.

FIG. 4A is a schematic top view of the actuator rod 306 and the actuator wedge 303 shown in FIG. 3, according to one implementation. The actuator rod 306 includes a rectangular section (such as a square section), the actuator wedge 303 is elliptical in shape, and the one or more outer surfaces 304 of the actuator wedge 303 are arcuate. FIG. 4A shows the locking assembly 390 in the unlocked position (described above for the locking assembly 190). The one or more first rollers 361 and the one or more second rollers 362 are spaced from each other by a distance DS1.

Turning the actuator nut 307 in the first rotational direction RD1 rotates the actuator wedge 303 such that the first and second rollers 361, 362 travel along the one or more outer surfaces 304 to increase the distance DS1 between the first and second rollers 361, 362. Increasing the distance DS1 actuates the first and second rams 308, 317 outward to the first position (described above for the locking assembly 190) for the locking assembly 390.

Figure 4B:
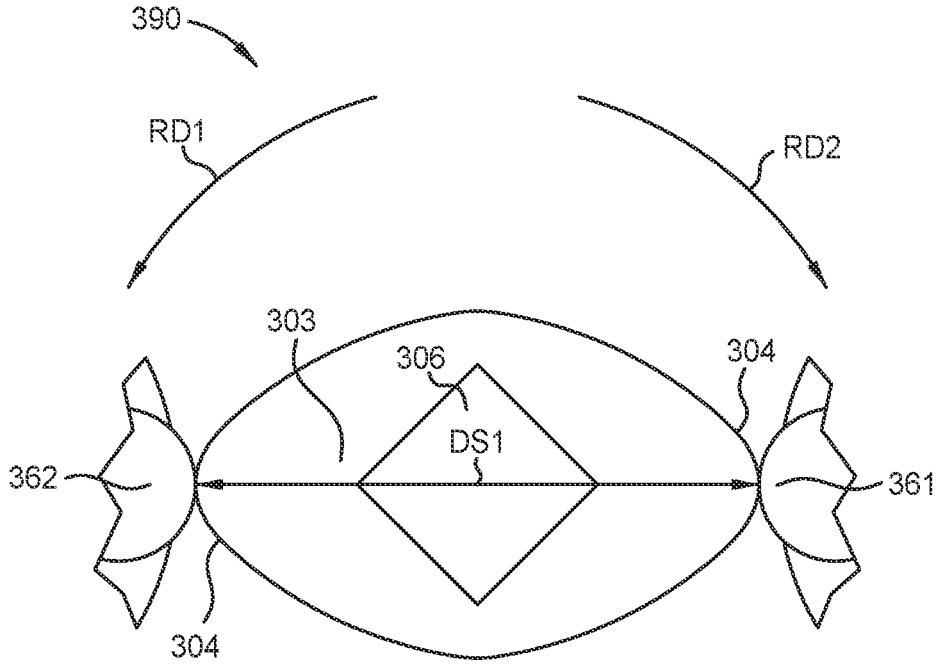
FIG. 4B is a schematic top view of the actuator rod and the actuator wedge shown in FIG. 3 in the locked position, according to one implementation.

FIG. 4B is a schematic top view of the actuator rod 306 and the actuator wedge 303 shown in FIG. 3 in the locked position, according to one implementation. In the implementation shown in FIG. 4B, the first distance DS1 is increased relative to the first distance DS1 in the unlocked position.

The retention pins 151, 152 can then be disposed through the one or more first pin openings 351 and the one or more second pin openings 352. After insertion of the retention pins 151, 152, the actuator wedge 303 can be further turned in the first rotational direction RD1, or turned in the second rotational direction RD2, to actuate the locking assembly 390 into the second position (described above for the locking assembly 190) and apply the locking forces L1, L2 using the first and second springs 123, 124. Moving the locking assembly 390 from the first position to the second position includes reducing the distance DS1 relative to the distance DS1 in the first position.

Figure 5:
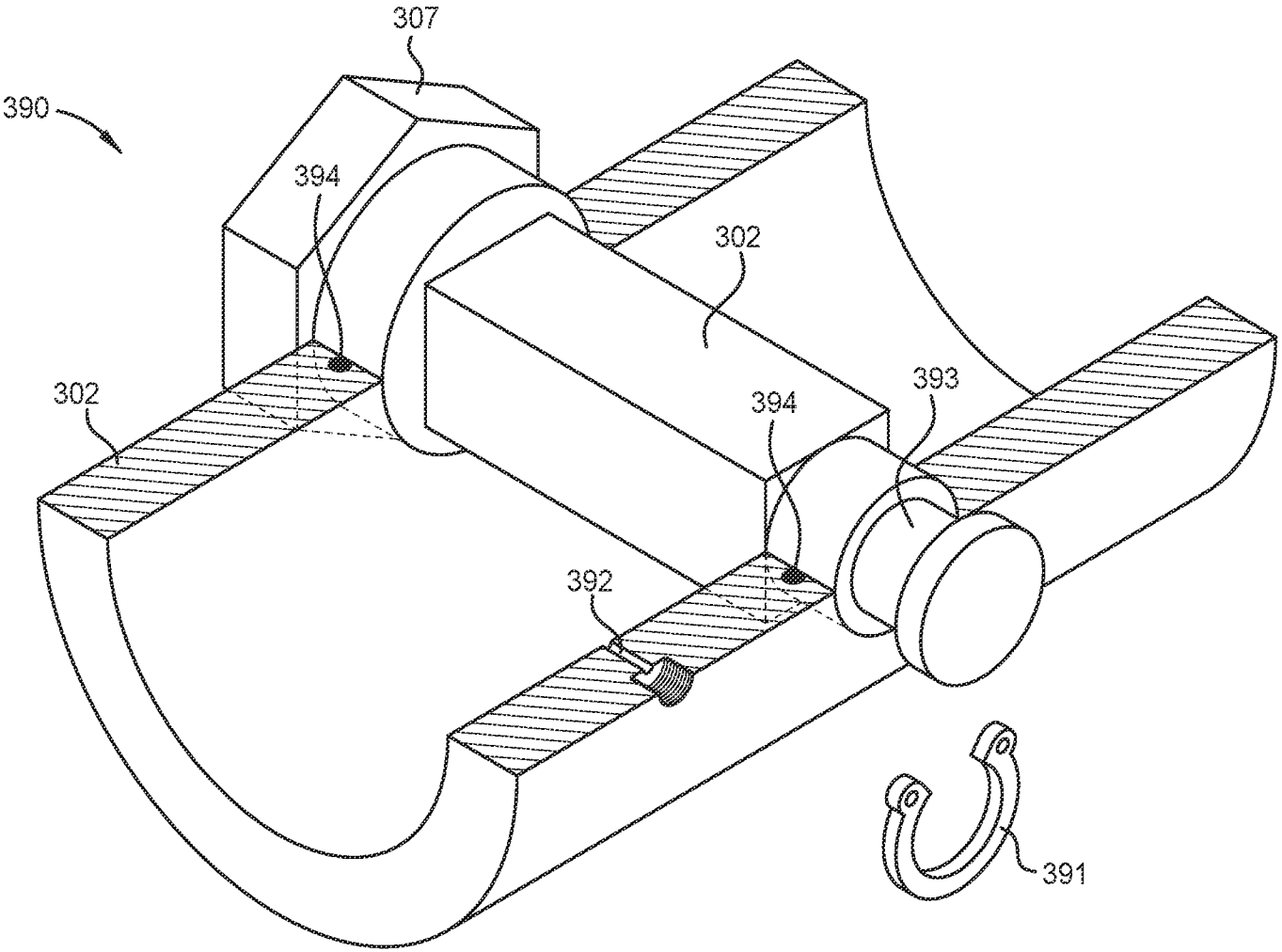
FIG. 5 is a schematic partial isometric cross-sectional view of the locking assembly shown in FIG. 3, according to one implementation.

FIG. 5 is a partial schematic isometric cross-sectional view of the locking assembly 390 shown in FIG. 3, according to one implementation. The one or more retainers 391 are disposed in a groove 393 formed in the actuator rod 306. The actuator rod 306 is a key drive. The locking assembly 390 includes one or more seals 394 (two are shown), such as O-ring seals.

Figure 6:
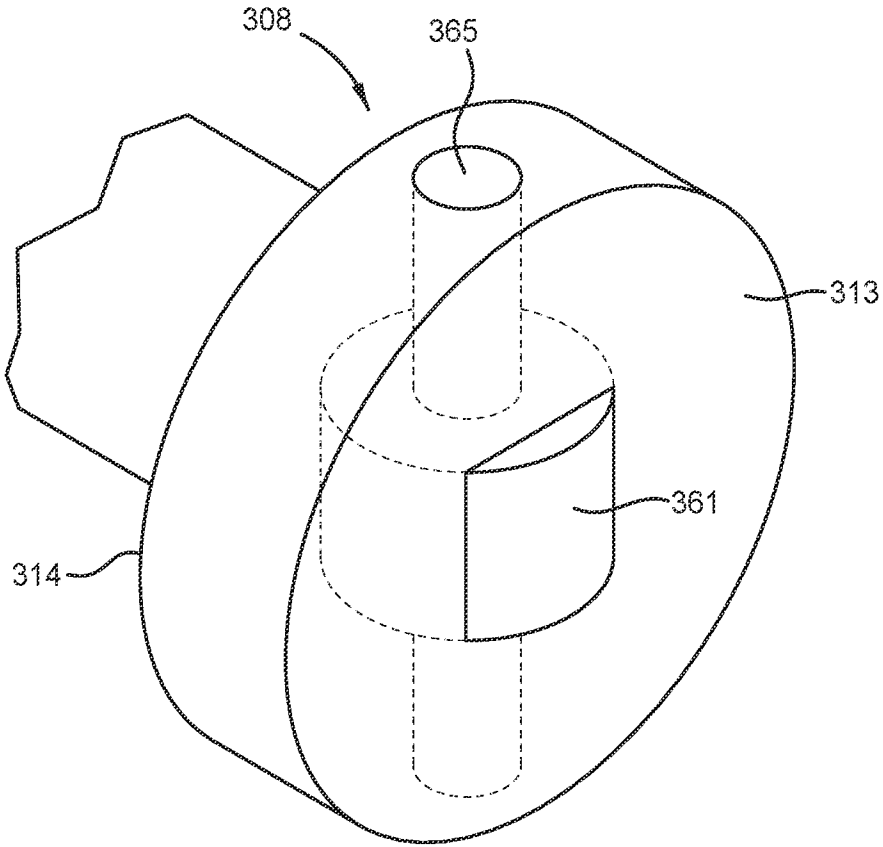
FIG. 6 is a schematic partial isometric view of a first ram shown in FIG. 3, according to one implementation.

FIG. 6 is a partial schematic isometric view of the first ram 308 shown in FIG. 3, according to one implementation. In one embodiment, which can be combined with other embodiments, the one or more first rollers 361 (one is shown) and the first rod 365 are part of a cam roller.

Figure 7:
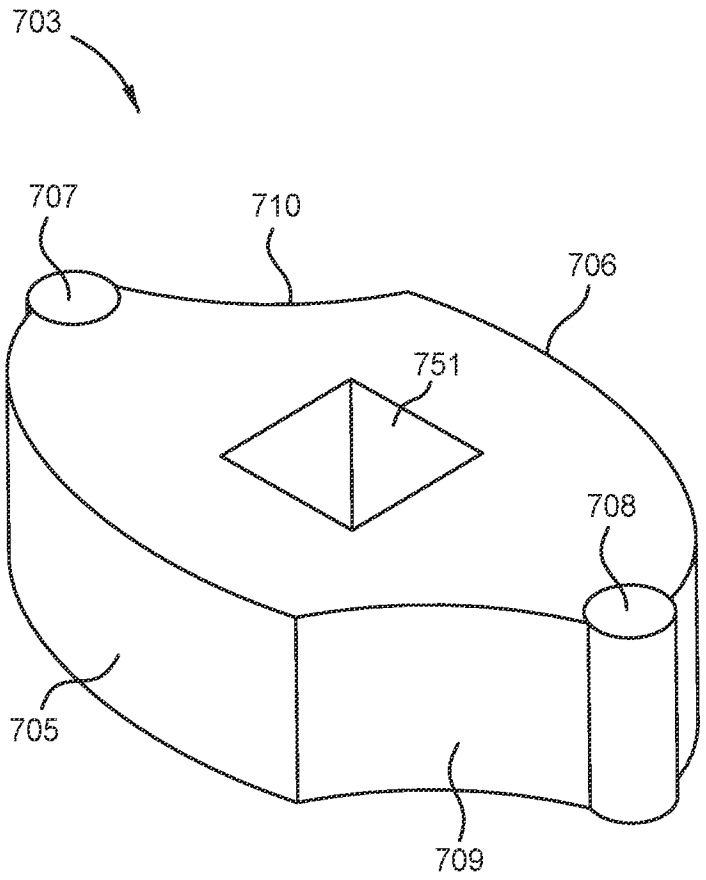
FIG. 7 is a schematic isometric view of an actuator wedge, according to one implementation.

FIG. 7 is a schematic isometric view of an actuator wedge 703, according to one implementation. Aspects, features, components, and/or properties of the actuator wedge 703 can be used in place of and/or in addition to the aspects, features, components, and/or properties of the actuator wedge 303 shown in FIG. 3.

The actuator wedge 703 is at least partially elliptical in shape, and includes a first outer surface 705 and a second outer surface 706. One or more first rollers 707 are disposed partially in the first outer surface 705 and one or more second rollers 708 are disposed partially in the second outer surface 706. A first recessed outer surface 709 is formed in the first outer surface 705 and a second recessed outer surface 710 is formed in the second outer surface 706. Each of the first outer surface 705, the second outer surface 706, the first recessed outer surface 709, and the second recessed outer surface 710 is arcuate. The actuator wedge 703 includes a central opening 751 to receive the actuator rod 306 therein to rotate the actuator wedge 703. When the actuator wedge 703 is rotated by the actuator rod 306 so that the first rollers 707 are in contact with the first rollers 361 of the first ram 308, and the second rollers 708 are in contact with the second rollers 362 of the second ram 317, the locking assembly 390 is moved into the position for insertion of the retention pins 151, 152 as described above.

Figure 8:
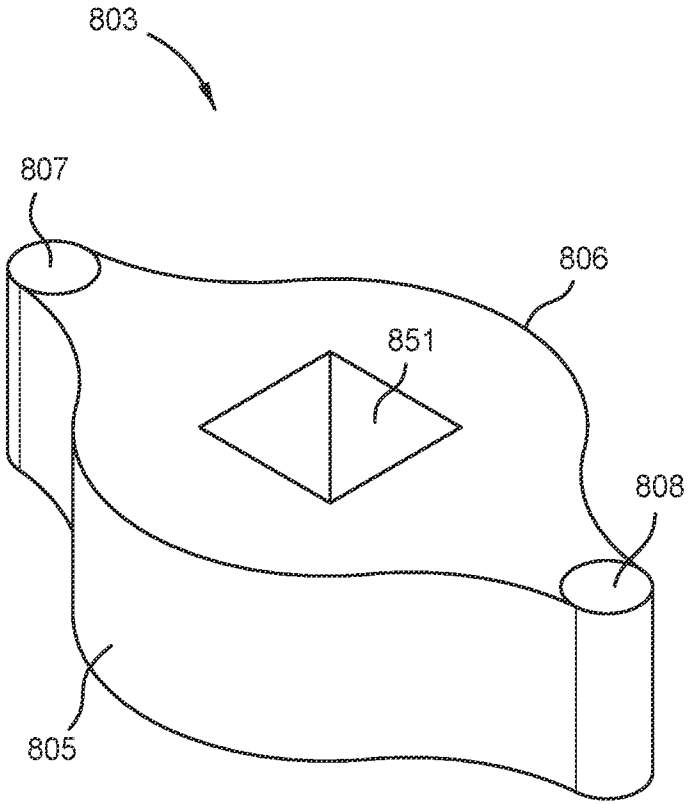
FIG. 8 is a schematic isometric view of an actuator wedge, according to one implementation.

FIG. 8 is a schematic isometric view of an actuator wedge 803, according to one implementation. Aspects, features, components, and/or properties of the actuator wedge 803 can be used in place of and/or in addition to the aspects, features, components, and/or properties of the actuator wedge 303 shown in FIG. 3.

The actuator wedge 803 includes a first outer surface 805 and a second outer surface 806. Each of the first outer surface 805 and the second outer surface 806 is arcuate, and is sinusoidal in shape. One or more first rollers 807 are disposed partially in the first and second outer surfaces 805, 806, and one or more second rollers 808 are disposed partially in the first and second outer surfaces 805, 806. The actuator wedge 803 includes a central opening 851 to receive the actuator rod 306 therein to rotate the actuator wedge 803. When the actuator wedge 803 is rotated by the actuator rod 306 so that the first rollers 807 are in contact with the first rollers 361 of the first ram 308, and the second rollers 808 are in contact with the second rollers 362 of the second ram 317, the locking assembly 390 is moved into the position for insertion of the retention pins 151, 152 as described above.

Figure 10:
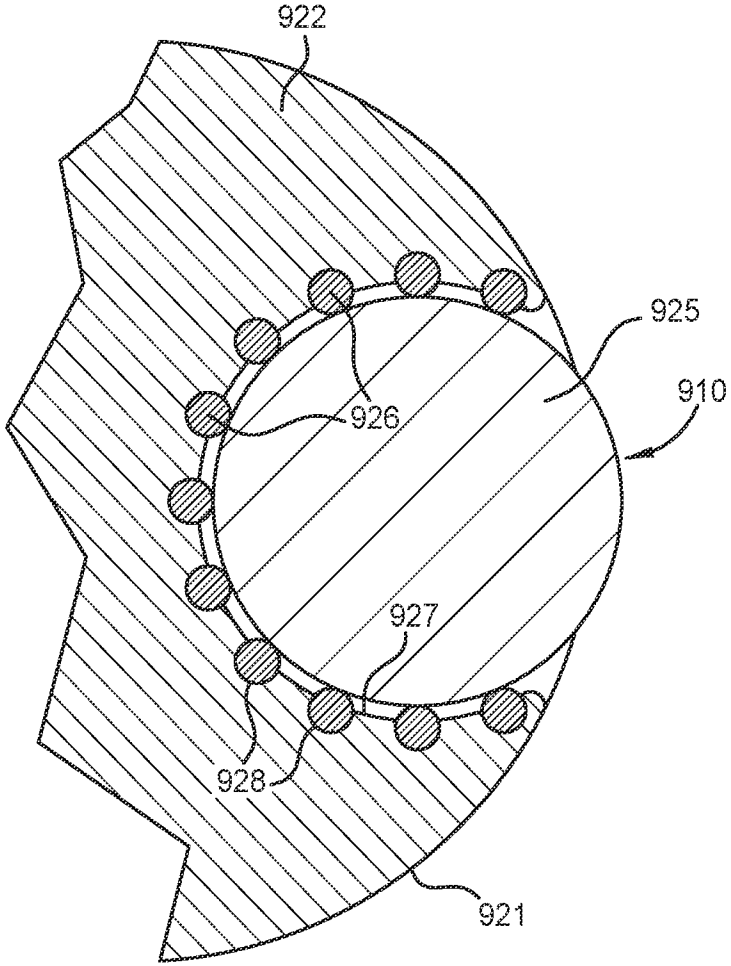
FIG. 10 is a schematic partial top cross-sectional view of the needle bearing roller shown in FIG. 9, according to one implementation.
Figure 9:
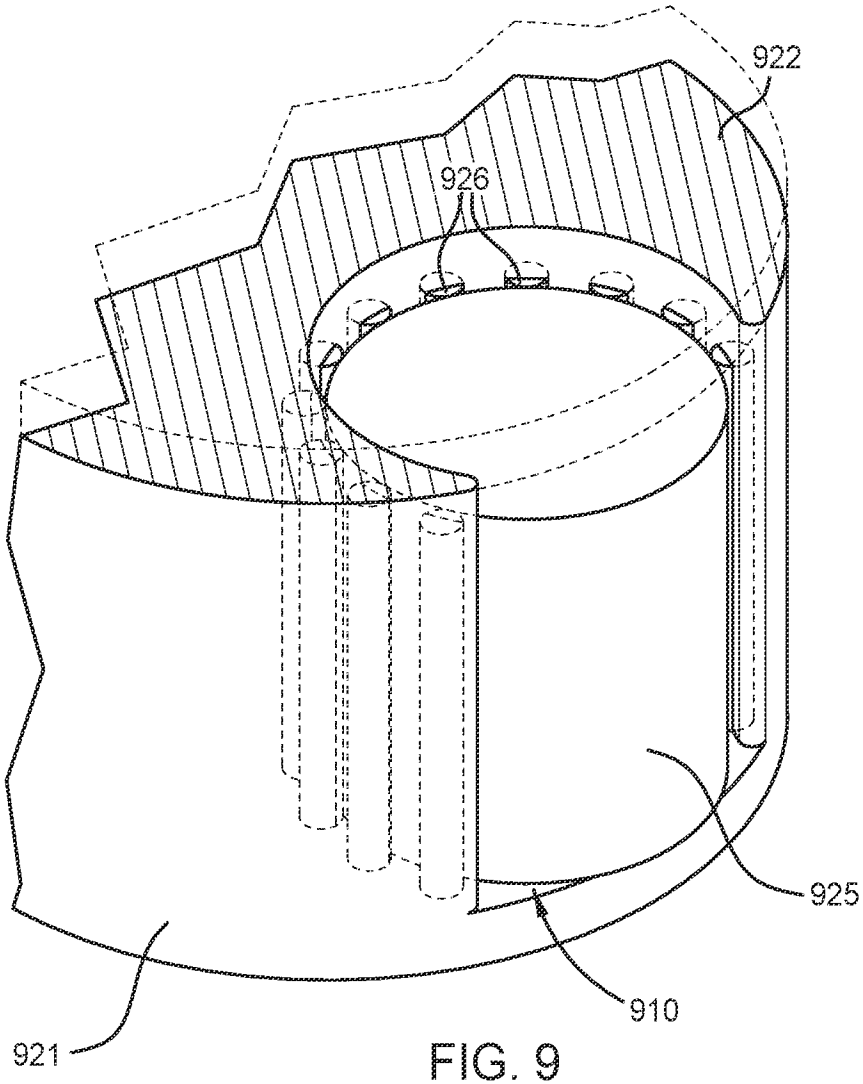
FIG. 9 is a schematic partial isometric view of a needle bearing roller disposed in an outer surface of a body, according to one implementation.

FIG. 9 is a partial schematic isometric view of a needle bearing roller 910 disposed in an outer surface 921 of a body 922 (such as the first ram 308 or the second ram 317 shown in FIG. 3), according to one implementation. FIG. 10 is a partial schematic top cross-sectional view of the needle bearing roller 910 shown in FIG. 9, according to one implementation. The needle bearing roller 910 includes a roller 925 (such as the first roller 361 or the second roller 362 as shown in FIG. 3) and a plurality of needle bearings 926 disposed between the roller 925 and a recessed outer surface 927 formed in the outer surface 921. The plurality of needle bearings 926 are disposed in a plurality of arcuate pockets 928 formed in the recessed outer surface 927. The roller 925 is rotatable at least partially with and/or relative to the needle bearings 926 to reduce rotational friction of the roller 925.

Figure 11:
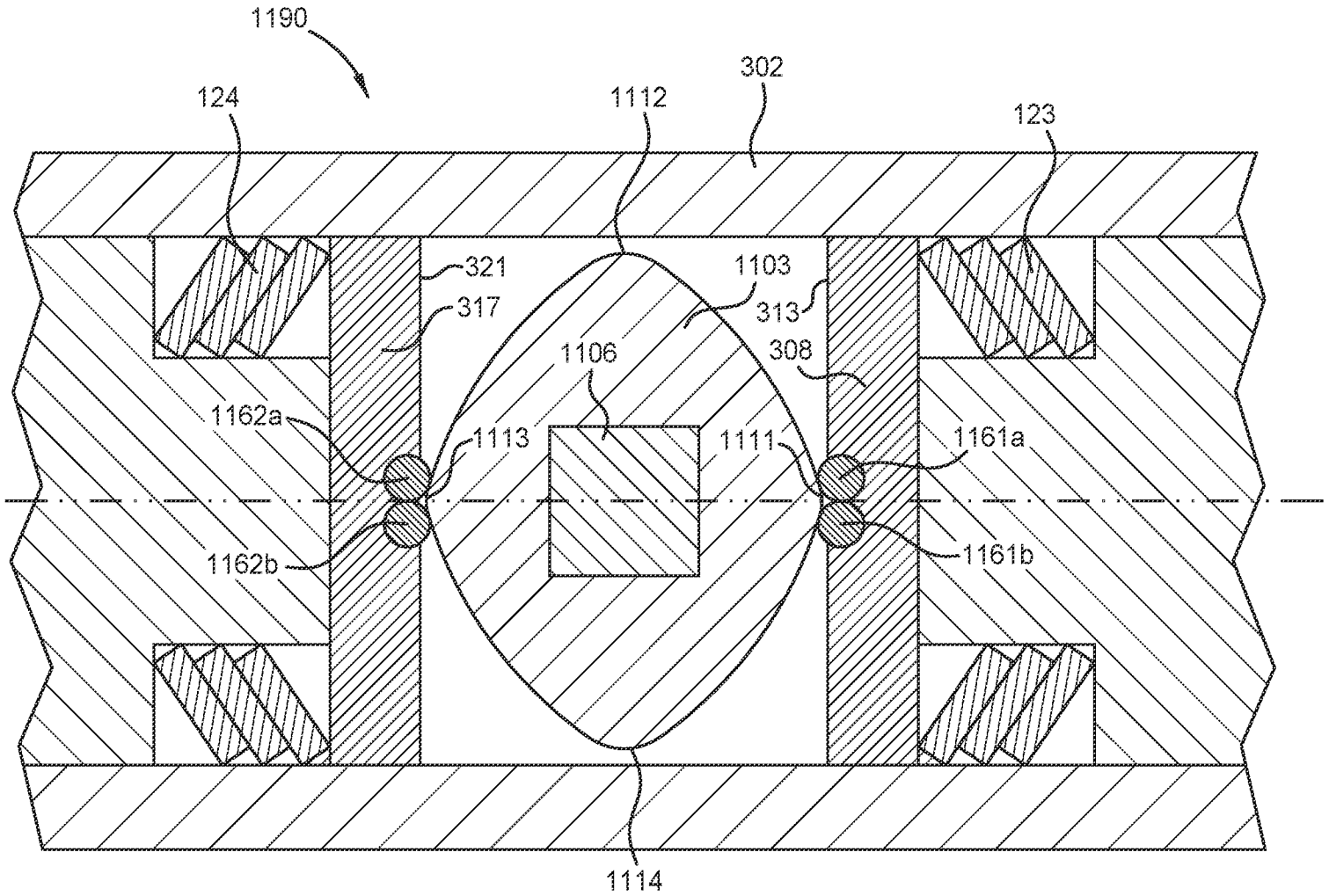
FIG. 11 is a schematic partial top cross-sectional view of a locking assembly, according to one implementation.

FIG. 11 is a partial schematic top cross-sectional view of a locking assembly 1190, according to one implementation. Aspects, features, components, and/or properties of the locking assembly 1190 can be used in place of and/or in addition to the aspects, features, components, and/or properties of the locking assembly 390 shown in FIG. 3.

The locking assembly 1190 is elliptical in shape and include four rounded edges 1111-1114. Two first rollers 1161*a*, 1161*b* are disposed partially in the first ram 308 and two second rollers 1162*a*, 1162*b* are disposed partially in the second ram 317. The locking assembly 1190 is shown in the unlocked position in FIG. 11. In the unlocked position, the first rollers 1161*a*, 1161*b* are disposed on opposing sides of the rounded edge 1111 and the second rollers 1161*a*, 1162*b* are disposed on opposing sides of the rounded edge 1113.

Figure 12A:
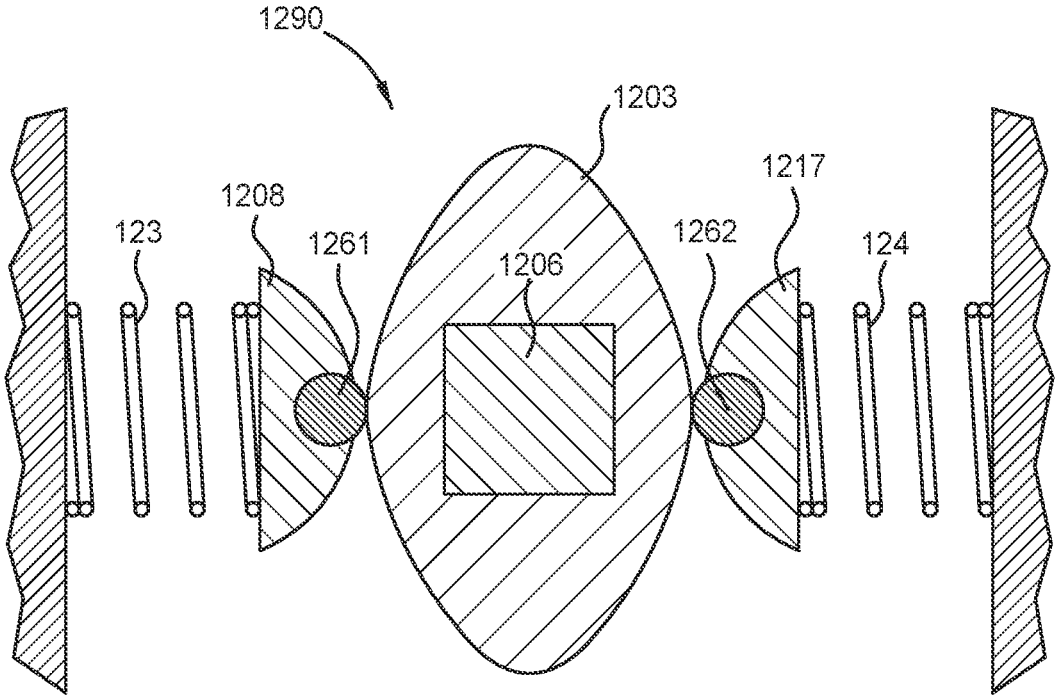
FIG. 12A is a schematic partial top view of a locking assembly in the unlocked position, according to one implementation.

FIG. 12A is a partial schematic top view of a locking assembly 1290 in the unlocked position, according to one implementation. Aspects, features, components, and/or properties of the locking assembly 1290 can be used in place of and/or in addition to the aspects, features, components, and/or properties of the locking assembly 390 shown in FIG. 3.

The locking assembly 1290 includes an actuator rod 1206, an actuator wedge 1203, a first ram 1208, and a second ram 1217. One or more first rollers 1261 are partially disposed in the first ram 1208, and one or more second rollers 1262 are partially disposed in the second ram 1217.

Figure 12B:
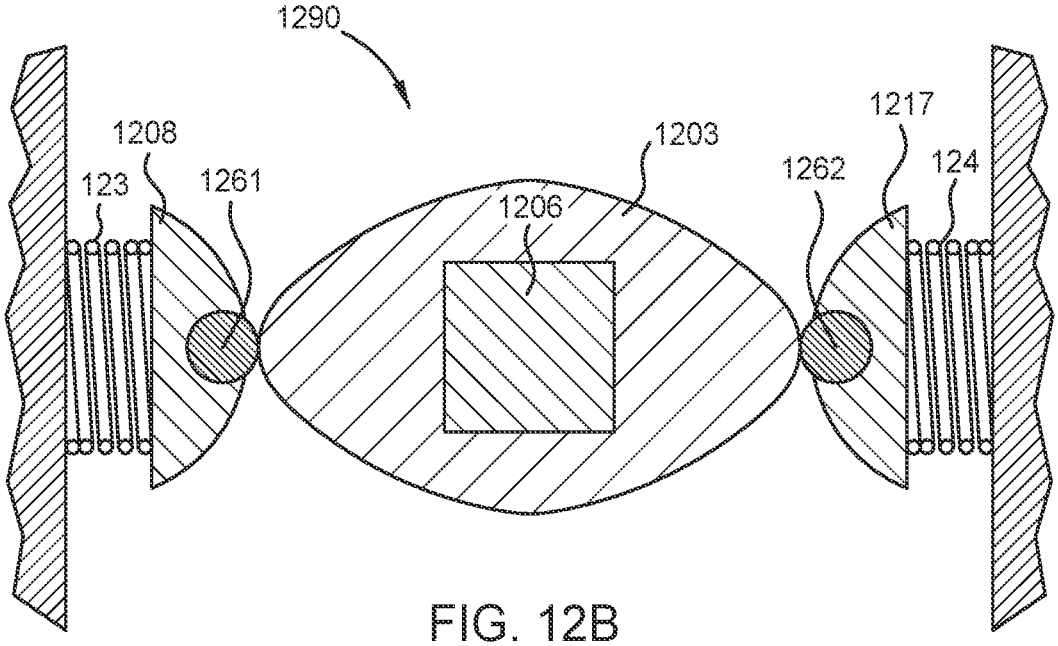
FIG. 12B is a schematic partial top view of the locking assembly shown in FIG. 12A in the first position, according to one implementation.

FIG. 12B is a partial schematic top view of the locking assembly 1290 shown in FIG. 12A in the first position, according to one implementation.

Figure 13:
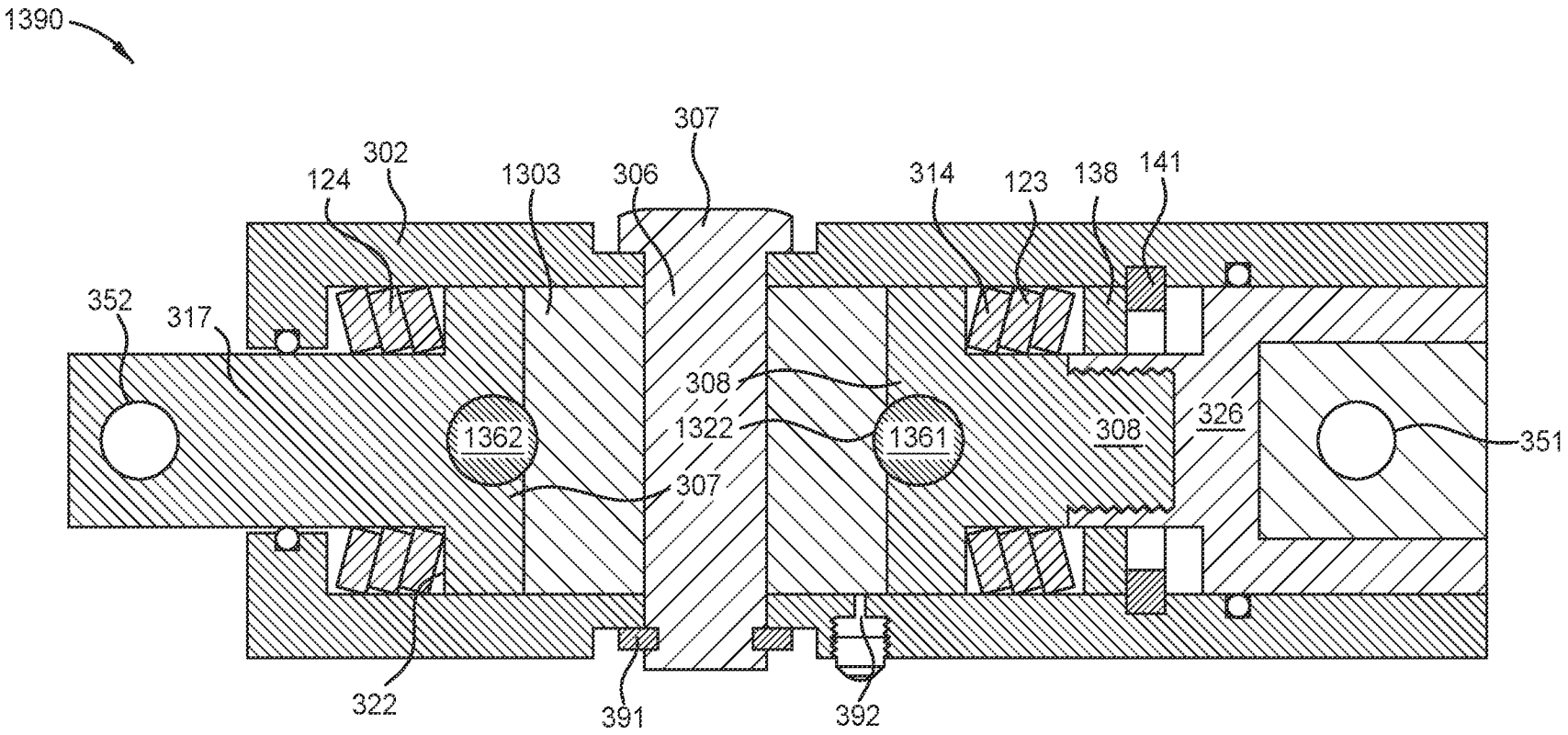
FIG. 13 is a schematic partial top view of a locking assembly in the unlocked position, according to one implementation.

FIG. 13 is a partial schematic top view of a locking assembly 1390 in the unlocked position, according to one implementation. Aspects, features, components, and/or properties of the locking assembly 1390 can be used in place of and/or in addition to the aspects, features, components, and/or properties of the locking assembly 390 shown in FIG. 3. The locking assembly 1390 is shown in the unlocked position in FIG. 13.

The locking assembly 1390 includes an actuator wedge 1303, one or more first rollers 1361 disposed partially in the first ram 308, and one or more second rollers 1362 disposed partially in the second ram 317. In the implementation shown in FIG. 13, each of the first and second rollers 1361, 1362 includes a ball bearing, such as a spherical ball bearing. The actuator rod 306 includes a rectangular section (such as a square section). The actuator rod 306 can include a circular section that is received in the actuator wedge 1303.

Figure 14:
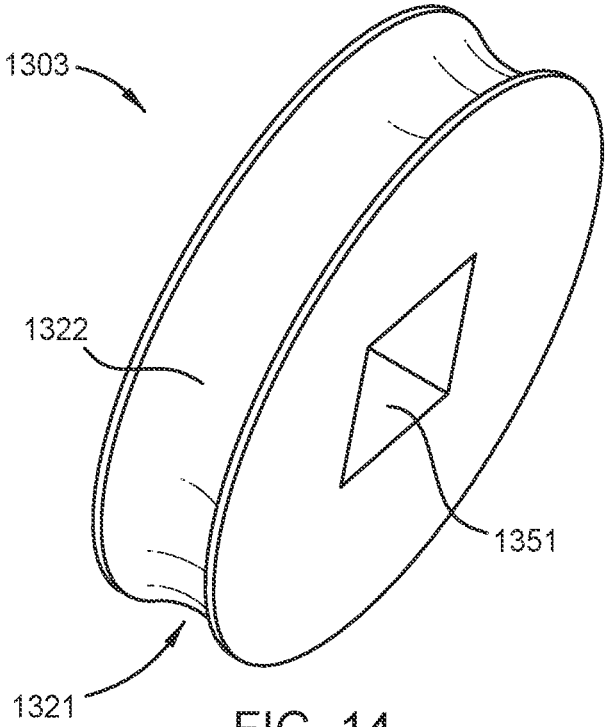
FIG. 14 is a schematic isometric view of an actuator wedge shown in FIG. 13, according to one implementation.

FIG. 14 is a schematic isometric view of the actuator wedge 1303 shown in FIG. 13, according to one implementation. The actuator wedge 1303 is circular in shape and includes a central opening 1351. The central opening 1351 is rectangular or square in shape, and the actuator rod 306 has a corresponding rectangle or square shape and is disposed through the central opening. The actuator wedge 1303 includes an outer groove 1321 and a concave outer surface 1322 defined at least partially by the outer groove 1321. The concave outer surface 1322 is arcuate to facilitate increased contact with the first and second rollers 1361, 1362.

Figure 15:
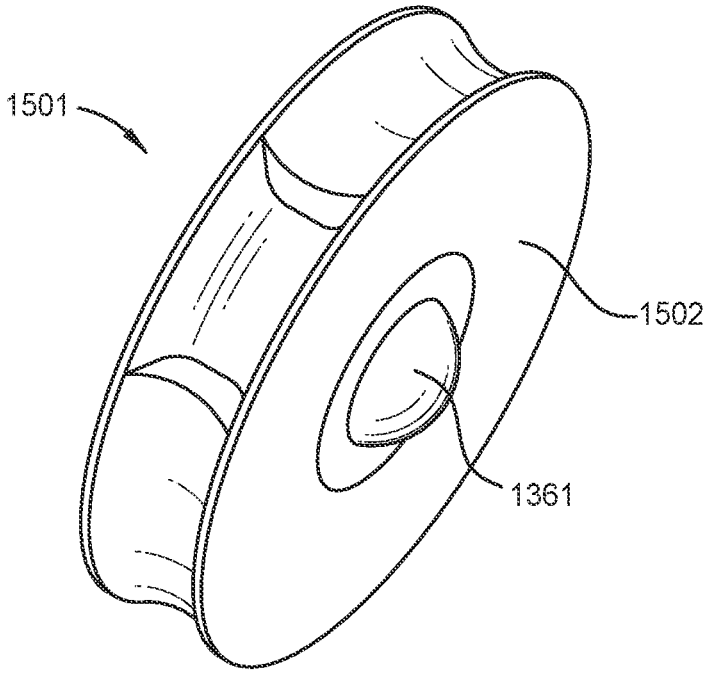
FIG. 15 is a schematic partial isometric view of a ram head, according to one implementation.

FIG. 15 is a partial schematic isometric view of a ram head 1501, according to one implementation. The ram head 1501 can be used as the ram head of the first ram 308 and the ram head of the second ram 317. In the implementation shown in FIG. 15, the one or more first rollers 1361 (one is shown) is disposed in the first inward surface 1502 of the ram head 1501, and the first roller is a spherical ball bearing. The ram head 1501 would be oriented 90 degrees relative to the actuator wedge 1303.

Figure 16:
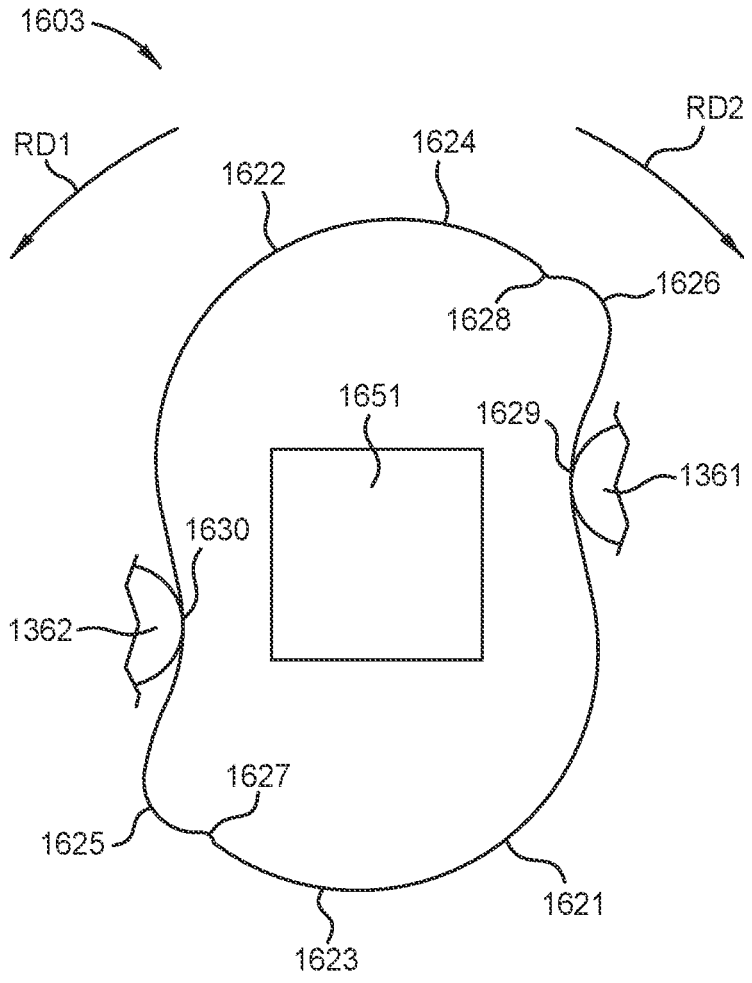
FIG. 16 is a schematic partial top view of an actuator wedge, according to one implementation.

FIG. 16 is a partial schematic top view of an actuator wedge 1603, according to one implementation. Aspects, features, components, and/or properties of the actuator wedge 1603 can be used in place of and/or in addition to the aspects, features, components, and/or properties of the actuator wedge 1303 shown in FIG. 13.

The actuator wedge 1603 includes a central opening 1651 to receive the actuator rod 306 therein. The actuator wedge 1603 includes a plurality of outer surfaces 1621-1630 that are arcuate. The outer surfaces 1621-1626 are convex and the outer surfaces 1627-1630 are concave. The outer surfaces 1621-1630 of the actuator wedge 1603 can include the profile of the concave outer surface 1322 shown in FIG. 14.

Turning the actuator wedge 1603 in the first rotational direction RD1 moves the rollers 1361, 1362 alone the outer surfaces 1621-1630. Turning the actuator wedge 1603 in the first rotational direction RD1 moves the rollers 1361, 1362 from the outer surfaces 1629, 1630 and to the outer surfaces 1621, 1622 to actuate the locking assembly 1390 from the unlocked position and to the first position. The retention pins 151, 152 are then disposed through the openings of the female end connection and the male end connection. The actuator wedge 1603 is then turned in the first rotational direction RD1 from the outer surfaces 1621, 1622 and to the outer surfaces 1627, 1628. The first and second springs 123, 124 then bias the locking assembly 1390 into the second position to applying the locking forces L1, L2 to the retention pins.

The actuator wedge 1603 is then turned in the first rotational direction RD1 from the outer surfaces 1627, 1628 and to the outer surfaces 1625, 1626 to reduce the locking forces L1, L2. The retention pins 151, 152 are then removed from the openings of the female end connection and the male end connection. The actuator wedge 1603 is then turned in the first rotational direction RD1 from the outer surfaces 1625, 1626 and to the outer surfaces 1629, 1629 to retract the first and second rams 308, 317.

The present disclosure contemplates that instead of continuing to turn the actuator wedge 1603 in the first rotational direction RD1, the actuator wedge 1603 can be turned in the second rotational direction RD2 to achieve operations described herein.

The present disclosure contemplates that each of the first and second rollers 361, 362, the first rollers 1161*a*, 1161*b*, the second rollers 1162*a*, 1162*b*, the first and second rollers 1261, 1262, and the first and second rollers 1361, 1362 can be a cam roller or a needle bearing roller. The present disclosure contemplates that each of the first and second rollers 707, 708 and each of the first and second rollers 807, 808 can be a needle bearing roller.

Figure 17:
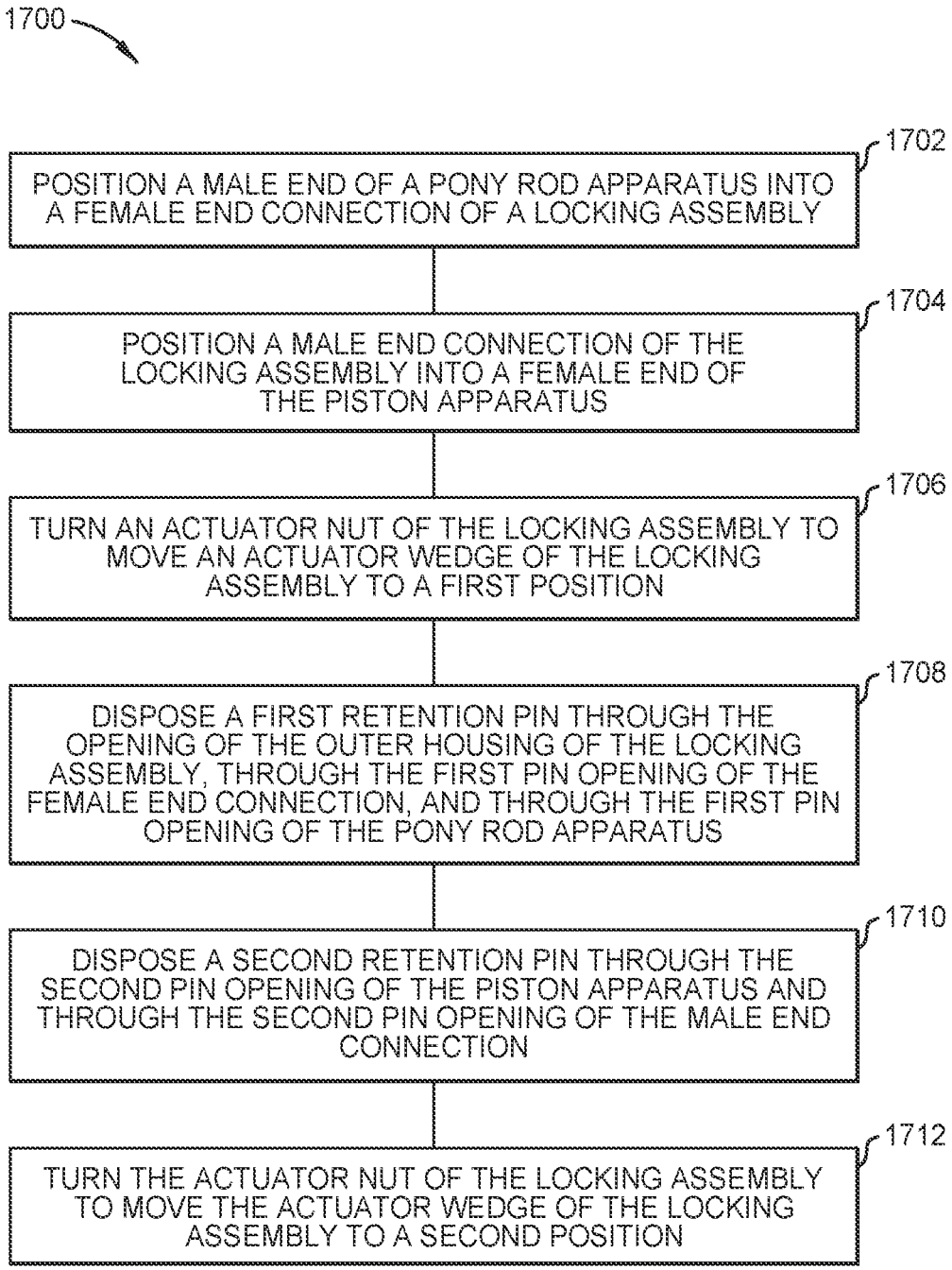
FIG. 17 is a schematic block diagram view of a method of using a pump system, according to one implementation.

FIG. 17 is a schematic block diagram view of a method 1700 of using a pump system, according to one implementation.

Operation 1702 includes positioning a male end of a pony rod apparatus into a female end connection of a locking assembly. The female end connection includes a first pin opening.

Operation 1704 includes positioning a male end connection of the locking assembly into a female end of the piston apparatus. The male end connection includes a second pin opening.

Operation 1706 includes turning an actuator nut of the locking assembly to move an actuator wedge of the locking assembly to a first position. The actuator rod is disposed through the actuator wedge and the actuator nut is disposed at a first end of the actuator rod. The movement of the actuator wedge to the first position includes actuating a first shoulder surface of a first ram and a second shoulder surface of a second ram outward to compress a first spring and a second spring, and aligning an opening of an outer housing of the locking assembly with the first pin opening of the female end connection and a first pin opening of the pony rod apparatus. The movement of the actuator wedge to the first position includes aligning a second pin opening of the piston apparatus with the second pin opening of the male end connection. The movement of the actuator wedge to the first position includes sliding one or more tapered outer surfaces of the actuator wedge along a first tapered surface of the first ram and a second tapered surface of the second ram.

The movement of the actuator wedge to the first position also includes rotating the actuator rod relative to the actuator wedge using a first threaded interface. The actuator nut is coupled to the first end of the actuator rod using a second threaded interface. The turning the actuator nut comprises rotating the actuator nut relative to the actuator rod using the second threaded interface. Each of the first spring and the second spring is a disc spring.

Operation 1708 includes disposing a first retention pin through the opening of the outer housing of the locking assembly, through the first pin opening of the female end connection, and through the first pin opening of the pony rod apparatus.

Operation 1710 includes disposing a second retention pin through the second pin opening of the piston apparatus and through the second pin opening of the male end connection.

Operation 1712 includes turning the actuator nut of the locking assembly to move the actuator wedge of the locking assembly to a second position. The movement of the actuator wedge to the second position includes biasing the first spring and the second spring inwardly against the first shoulder surface of the first ram and the second shoulder surface of the second ram to bias the first retention pin with the female end connection and bias the second retention pin with the male end connection. The movement of the actuator wedge to the second position includes applying locking forces inwardly against the first retention pin and the second retention pin.

The first ram is disposed in an outer housing and disposed on a first side of the actuator wedge. The first ram includes a first ram head having a first inward surface and the first shoulder surface opposing the first inward surface. The first ram includes a first ram rod, and the first spring is disposed about the first ram rod. The second ram is disposed in the outer housing and disposed on a second side of the actuator wedge. The second ram includes a second ram head having a second inward surface and the second shoulder surface opposing the second tapered surface. The second ram includes a second ram rod, and the second spring is disposed about the second ram rod.

Figure 18:
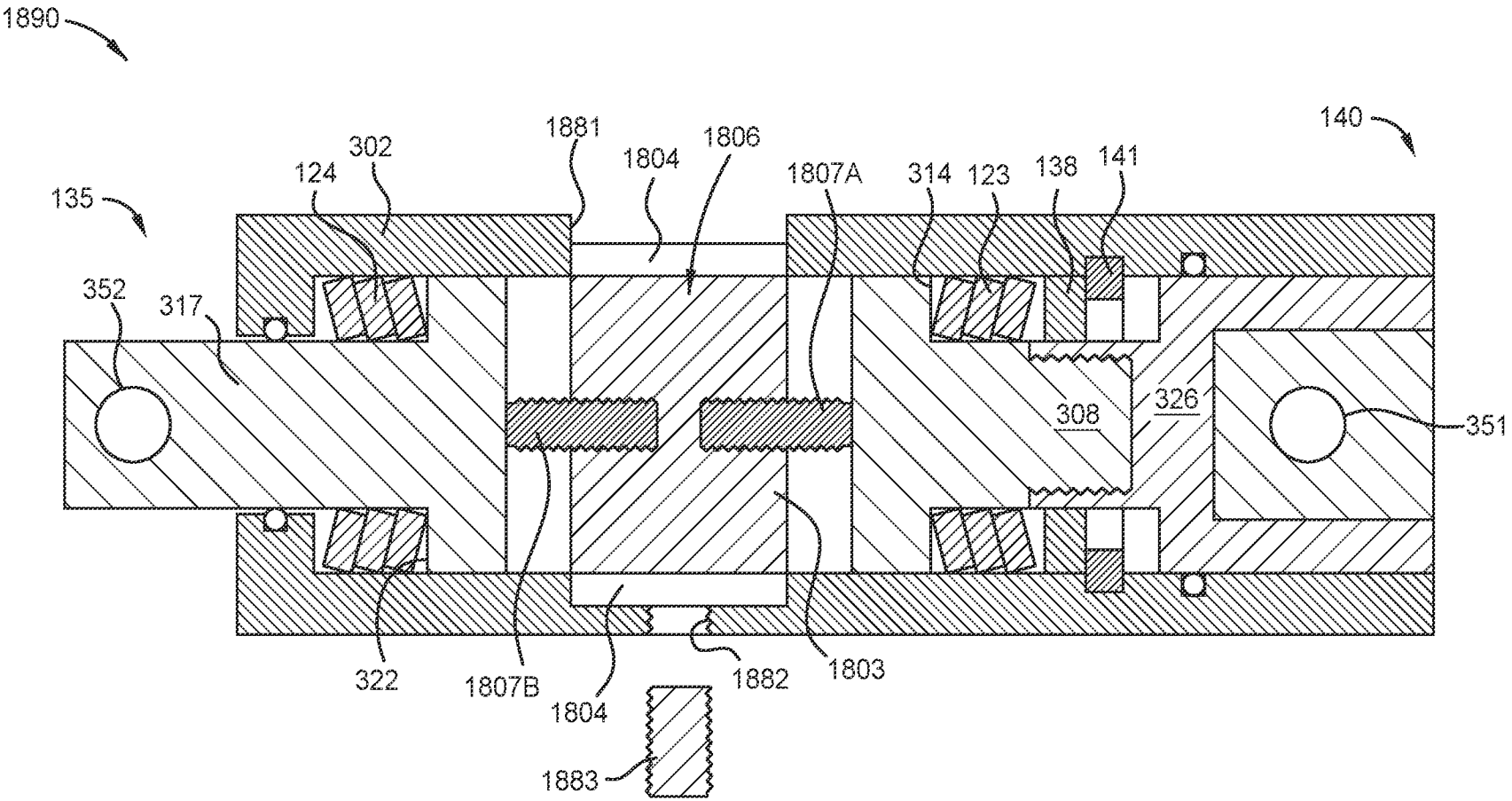
FIG. 18 is a schematic partial sectional view of a locking assembly, according to one implementation.

FIG. 18 is a schematic partial sectional view of a locking assembly 1890, according to one implementation. Aspects, features, components, and/or properties of the locking assembly 1890 can be used in place of and/or in addition to the aspects, features, components, and/or properties of at least the locking assemblies 190, 390, 1390. The locking assembly 1890 is shown in the unlocked position in FIG. 18.

The locking assembly 1890 includes an actuator 1806 and one or more drive members 1807A, 1807B disposed in the outer housing 302. The actuator 1806 may be in the form of a cylindrical body 1803 having one or more slots 1804 formed in the outer surface of the cylindrical body 1803. The drive members 1807A, 1807B may be in the form of threaded rods that are threadedly coupled to the actuator 1806. One end of the drive member 1807A is threaded into the actuator 1806, and the opposite end abuts up against the first ram 308. One end of the drive member 1807B is threaded into the actuator 1806, and the opposite end abuts up against the second ram 317.

Rotation of the actuator 1806 in a first direction about the longitudinal axis of the locking assembly 1890 moves the drive members 1807A, 18078 outward of the actuator 1806. Rotation of the actuator 1806 in a second, opposite direction about the longitudinal axis of the locking assembly 1890 moves the drive members 1807A, 18078 inward of the actuator 1806. Specifically, the threaded engagement between the actuator 1806 and the drive members 1807A, 18078 moves the drive members 1807A, 18078 outward and inward relative to the actuator 1806 when the actuator 1806 is rotated.

Upon rotation of the actuator 1806 in the first direction, the drive member 1807A moves the first ram 308 and the female end connector 326 in a direction away from the actuator 1806, thereby compressing the first spring 123 between the first shoulder surface 314 of the first ram 308 and the first spacer ring 138, which is supported by the first retainer ring 141. The first spring 123 biases the first ram 308 toward the actuator 1806. The retention pin 151 can then be disposed through the first pin opening 351 to couple the locking assembly 1890 to the piston apparatus 140 (also referred to as a plunger apparatus). The actuator 1806 can then be rotated in the second, opposite direction to retract the drive member 1807A inward and allow the first spring 123 to apply the retention force to the first ram 308 and the female end connector 326.

Similarly, upon rotation of the actuator 1806 in the first direction, the drive member 18078 moves the second ram 317 in a direction away from the actuator 1806, thereby compressing the second spring 124 between the second shoulder surface 322 of the second ram 317 and an inner shoulder of the outer housing 302. The second spring 124 biases the second ram 317 toward the actuator 1806. The retention pin 152 can then be disposed through the second pin opening 352 to couple the locking assembly 1890 to the pony rod apparatus 135. The actuator 1806 can then be rotated in the second, opposite direction to retract the drive member 1807A inward and allow the second spring 124 to apply the retention force to the second ram 317. In one embodiment, the first ram 308 and the second ram 317 can be switched such that the first ram 308 couples to the pony rod apparatus 135, and the second ram 317 couples to the piston apparatus 140. In other words, the first ram 308 itself may be configured as a male end connection with the pin opening 351, and the second ram 317 itself may be configured as a female end connection with the pin opening 352 or used with the female end connection 326.

An opening 1881 may be formed through the outer housing 302 to access and rotate the actuator 1806. A tool may be used to engage one or more of the slots 1804 of the actuator 1806 to rotate the actuator 1806. A retention pin opening 1882 may also be formed through the outer housing 302. A retention pin 1883, such a threaded screw, may be inserted and/or threaded through the retention pin opening 1882 such that the retention pin 1883 extends into one of slots 1804 to prevent rotation of and lock the actuator 1806 in place to help install and uninstall the locking assembly 1890. The retention pin 1882 can be removed when needed to rotate the actuator 1806.

Figure 19:
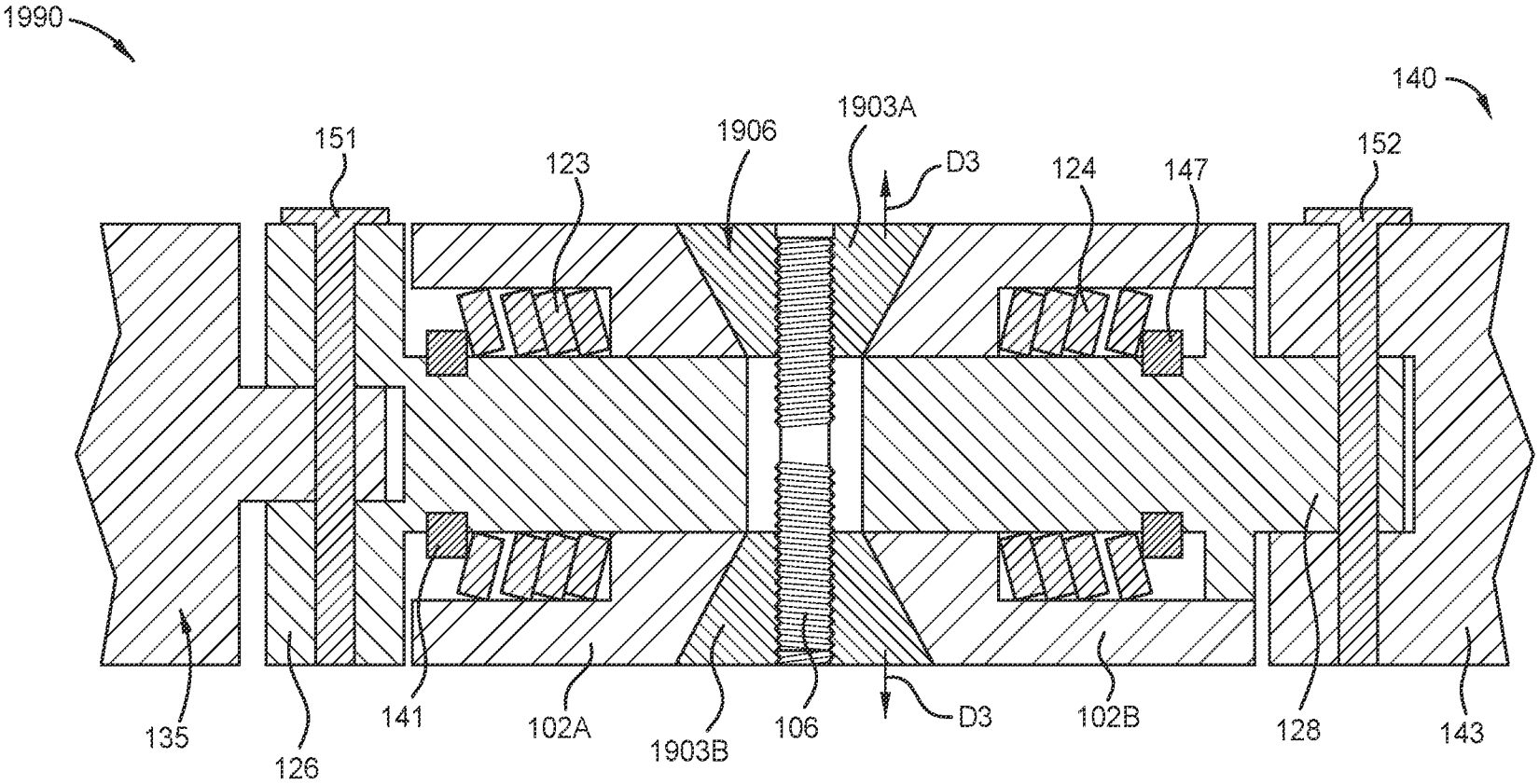
FIG. 19 is a schematic partial sectional view of a locking assembly, according to one implementation.

FIG. 19 is a schematic partial sectional view of a locking assembly, according to one implementation. Aspects, features, components, and/or properties of the locking assembly 1990 can be used in place of and/or in addition to the aspects, features, components, and/or properties of at least the locking assemblies 190, 390, 1390, 1890. The locking assembly 1990 is shown in the locked position in FIG. 19.

The outer housing 102 of the locking assembly 1990 comprises a first outer housing 102A and a second outer housing 102B. An actuator 1906 of the locking assembly 1990 comprises a first actuator wedge 1903A and a second actuator wedge 1903B. Each actuator wedge 1903A, 1903B comprises tapered surfaces that engage corresponding tapered surfaces on the outer housings 102A, 102B.

The actuator rod 106 extends through each actuator wedge 1903A, 1903B. Rotation of the actuator rod 106 in a first direction causes the actuator wedges 1903A, 19038 to move radially outward in a direction D3 away from each other and relative to the outer housings 102A, 102B. The actuator rod 106 may comprise a first threaded portion that when rotated in the first direction causes the first actuator wedge 1903A to move radially outward in the direction D3 away from the second actuator wedge 1903B. The actuator rod 106 may also comprise a second threaded portion that when rotated in the first direction causes the second actuator wedge 1903A to move radially outward in the direction D3 away from the first actuator wedge 1903A.

As the actuator wedges 1903A, 19038 move radially outward, the first and second springs 123, 124 are allowed to expand and move the first and second outer housings 102A, 102B in a direction inward towards each other. The first spring 123 is disposed between an inner shoulder of the first outer housing 102A and the first retainer ring 141, which is disposed in a recess formed in the female end connection 126. The second spring 124 is disposed between an inner shoulder of the second outer housing 1028 and the second retainer ring 147, which is disposed in a recess formed in the male end connection 128. The female end connection 126 and the male end connection 128 may be integrally formed out of a single piece, may be two separate pieces, or may be two separate pieces that are coupled together directly or indirectly by one or more components. The retention pin 151 can then be disposed through the female end connection 126 and the pony rod apparatus 135 to couple the locking assembly 1990 to the pony rod apparatus 135. The retention pin 152 can then be disposed through the male end connection 128 and the female end 143 of the piston apparatus 140 (also referred to as a plunger apparatus) to couple the locking assembly 1990 to the piston apparatus 140. In an alternative embodiment, the retention pins 151, 152 can be disposed through the outer housings 102A, 102B and the end connections 126, 128, respectively. In one embodiment, the female end connection 126 and the male end connection 128 can be switched such that the female end connection 126 couples to the piston apparatus 140, and the male end connection 128 couples to the pony rod apparatus 135.

Rotation of the actuator rod 106 in the opposite direction causes the actuator wedges 1903A, 1903B to move radially inward toward each other and into the position illustrated in FIG. 18. As the actuator wedges 1903A, 1903B move radially inward toward each other, the outer housings 102A, 102B are moved in a direction away from each other. The first spring 123 is compressed between the inner shoulder of the first outer housing 102A and the first retainer ring 141. Similarly, the second spring 124 is compressed between the inner shoulder of the second outer housing 102B and the second retainer ring 147. The compressed first and second springs 123, 124 apply the retention force to the retention pins 151, 152 via the male and female end connections 126, 128 of the locking assembly 1990 to maintain the connection with the pony rod apparatus 135 and the piston apparatus 140.

Benefits of the present disclosure include reliably maintaining locking forces; quickly and easily releasing components for servicing, repair, and/or replacement of pump components; ease of use of locking assembly; reduced complexity in manufacturing and assembly; reduced costs; and reduced operational delays and time. As an example, it is believed that the locking assemblies disclosed herein can be unlocked, and the fluid end piston rod apparatus can be released and removed from the fluid end in 30 seconds or less. The cost and time savings can be substantial, such as for service intervals where a component (such as a liner of the fluid end) is serviced, repaired, and/or replaced at a service interval (such as every 100 operational hours).

Other operations can take as long as 10 minutes or more, and can even take 5-10 hours or more. As another example, the locking assemblies disclosed herein can apply locking forces to the retention pins even if the actuator wedges move during operations, such as drilling or frac pumping operations. As another example, the locking assembles disclosed herein are mechanical and are simpler, easier to use, and incurring less expenditure of resources than other operations, such as operations using hydraulic pressure or pneumatic pressure that can be as large as 10,000 psi or more.

It is contemplated that one or more of the aspects disclosed herein may be combined. As an example, it is contemplated that one or more of the aspects, features, components, and/or properties of the pump system 100, the locking assembly 190, the locking assembly 390, the first ram 308, the actuator wedge 703, the actuator wedge 803, the needle bearing roller 910, the locking assembly 1190, the locking assembly 1290, the locking assembly 1390, the actuator wedge 1303, the ram head 1501, the actuator wedge 1603, the method 1700, the locking assembly 1890, and/or the locking assembly 1990. Moreover, it is contemplated that one or more of these aspects may include some or all of the aforementioned benefits.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A locking assembly, comprising:
an outer housing;
an end connection disposed at an end of the outer housing and comprising:
a pin opening at a first end configured to receive a retention pin; and
a roller at a second end, wherein the roller is disposed about a rod coupled to the second end of the end connection;
a spring member disposed in the outer housing and configured to move the end connection in a direction inward of the outer housing; and
an actuator at least partially disposed within the outer housing engagable with the roller, wherein:
the actuator is rotatable into a first position to move the roller to compress the spring member and move the end connection in a direction outward of the outer housing; and
the actuator is rotatable from the first position into a second position to allow the spring member to move the end connection in the direction inward of the outer housing.

2. The locking assembly of claim 1, wherein the actuator comprises a first surface portion, and wherein when the actuator is in the first position, the first surface portion engages with the roller to compress the spring member and move the end connection in the direction outward of the outer housing.

3. The locking assembly of claim 2, wherein the first surface portion is a curved surface portion that engages with the roller to compress the spring member and move the end connection in the direction outward of the outer housing.

4. The locking assembly of claim 3, wherein the actuator comprises a second surface portion adjacent to the first surface portion, and wherein the first and second surface portions have different thicknesses as measured from a centerline of the actuator.

5. The locking assembly of claim 4, wherein a thickness of the first surface portion is greater than a thickness of the second surface portion.

6. The locking assembly of claim 5, wherein when the actuator is rotated from the first position to the second position, the second surface portion allows the spring member to move the end connection in the direction inward of the outer housing.

7. The locking assembly of claim 2, wherein the actuator is rotatable 90 degrees from the first position into the second position, and wherein the actuator is rotatable 90 degrees from the second position into the first position.

8. The locking assembly of claim 7, wherein the outer housing comprises an end cap and the end connection comprises a spring retainer, wherein the spring member is disposed between the end cap and the spring retainer.

9. The locking assembly of claim 8, wherein the end cap comprises a center opening through which the end connection is disposed.

10. The locking assembly of claim 9, wherein when the actuator is rotated from the second position into the first position, a curved surface portion of the first surface portion of the actuator moves the roller to compress the spring member between the spring retainer and the end cap, and move the end connection in the direction outward of the outer housing.

11. The locking assembly of claim 10, wherein when the actuator is rotated from the first position into the second position, the curved surface portion of the first surface portion of the actuator is moved out of contact with the roller to allow the spring member to move the end connection in the direction inward of the outer housing.

12. The locking assembly of claim 1, further comprising:
a second end connection disposed at an opposite end of the outer housing and comprising a second pin opening at a first end configured to receive a second retention pin and a second roller at a second end; and
a second spring member disposed in the outer housing and configured to move the second end connection in a direction inward of the outer housing, wherein:
the actuator is engagable with the second roller;
the actuator is rotatable into the first position to move the second roller to compress the second spring member and move the second end connection in a direction outward of the outer housing; and
the actuator is rotatable from the first position into the second position to allow the second spring member to move the second end connection in the direction inward of the outer housing.

13. The locking assembly of claim 12, wherein the end connection is a female end connection, and wherein the second end connection is a male end connection.

14. A locking assembly, comprising:
an outer housing;
an end connection extending from the outer housing and comprising:
a pin opening at a first end configured to receive a retention pin; and
a roller at a second end, wherein the roller is disposed about a rod coupled to the second end of the end connection;
a spring member disposed in the outer housing and configured to move the end connection in a direction inward of the outer housing; and
an actuator at least partially disposed within and rotatable relative to the outer housing, wherein the actuator is configured to engage with the roller to compress the spring member and move the end connection in a direction outward of the outer housing.

15. The locking assembly of claim 14, wherein the actuator is rotatable 90 degrees between a first position and a second position, wherein the actuator moves the roller to compress the spring member when rotated into the first position, and wherein the actuator does not compress the spring member when rotated into the second position.

16. The locking assembly of claim 15, wherein the actuator comprises a curved surface portion that engages with the roller to compress the spring member and move the end connection in the direction outward of the outer housing when rotated from the second position to the first position.

17. The locking assembly of claim 16, wherein the actuator comprises a second surface portion adjacent to the curved surface portion, and wherein a thickness of the curved surface portion is greater than a thickness of the second surface portion.

18. The locking assembly of claim 17, wherein when the actuator is rotated from the first position to the second position, the second surface portion allows the spring member to expand and move the end connection in the direction inward of the outer housing.

19. The locking assembly of claim 15, wherein the outer housing comprises an end cap and the end connection comprises a spring retainer, wherein the spring member is disposed between the end cap and the spring retainer.

20. The locking assembly of claim 19, wherein the end cap comprises a center opening through which the end connection is disposed.

21. The locking assembly of claim 20, wherein the actuator is rotatable 90 degrees from the second position into the first position to move a curved surface portion of the actuator into contact with the roller to move the spring retainer to compress the spring member between the spring retainer and the end cap, and to move the end connection in the direction outward of the outer housing.

22. The locking assembly of claim 21, wherein the actuator is rotatable 90 degrees from the first position into the second position to move the curved surface portion of the actuator out of contact with the roller to allow the spring member to expand and move the end connection in the direction inward of the outer housing.

23. The locking assembly of claim 14, further comprising:

a second end connection disposed at an end of the outer housing opposite from the end connection, and comprising a second pin opening at a first end configured to receive a second retention pin and a second roller at a second end; and a second spring member disposed in the outer housing and configured to move the second end connection in a direction inward of the outer housing, wherein the actuator is configured to move the second roller to compress the second spring member and move the second end connection in a direction outward of the outer housing.

24. The locking assembly of claim 23, wherein the end connection is a female end connection, and wherein the second end connection is a male end connection.

* * * * *